US007574831B2

(12) United States Patent
Meyers

(10) Patent No.: US 7,574,831 B2
(45) Date of Patent: Aug. 18, 2009

(54) RISER PAN COMPONENT FOR ON-SITE WASTE SYSTEMS

(75) Inventor: Theodore W. Meyers, Barrington, IL (US)

(73) Assignee: Tuf-Tite, Inc., Lake Zurich, IL (US)

( * ) Notice: Subject to any disclaimer, the term of this patent is extended or adjusted under 35 U.S.C. 154(b) by 829 days.

(21) Appl. No.: 10/352,086

(22) Filed: Jan. 28, 2003

(65) Prior Publication Data

US 2003/0145527 A1 Aug. 7, 2003

Related U.S. Application Data

(60) Provisional application No. 60/353,620, filed on Feb. 1, 2002.

(51) Int. Cl.
*E02D 29/00* (2006.01)

(52) U.S. Cl. ..... 52/21; 52/20; 404/25

(58) Field of Classification Search ..... 52/19, 52/20, 21, 98, 100, 141; 404/25, 26
See application file for complete search history.

(56) References Cited

U.S. PATENT DOCUMENTS

| | | | |
|---|---|---|---|
| 537,182 | A | 4/1895 | Brown |
| 871,977 | A | 11/1907 | Winslow |
| 1,258,839 | A | 3/1918 | Wheeler |
| 1,469,459 | A | 10/1923 | Quigley |
| 1,712,510 | A | 5/1929 | Monie |
| 1,793,038 | A | 2/1931 | Zimmerman |
| 2,110,788 | A | 3/1938 | Brauer |
| 2,111,462 | A | 3/1938 | Simpson |
| 2,344,206 | A | 3/1944 | Forni |
| 2,545,577 | A | 3/1951 | Griffin |
| 3,048,911 | A | 8/1962 | Almon |

(Continued)

FOREIGN PATENT DOCUMENTS

| | | |
|---|---|---|
| DE | 1 964 319 | 7/1971 |

(Continued)

OTHER PUBLICATIONS

Polylok, Inc. brochure entitled "Polylok's new Super Risers" (understood to be published in Apr. 2002).

(Continued)

*Primary Examiner*—J. Allen Shriver
*Assistant Examiner*—Steven Marsh
(74) *Attorney, Agent, or Firm*—Marshall, Gerstein & Borun LLP

(57) ABSTRACT

An integrally formed riser pan member for use as a modular component within an access passageway for an on-site waste disposal system, such as a septic tank, to receivably retain a secondary cover member within, the riser pan member including a cylindrical body having an upper portion having a vertical wall member adapted to receive another modular passageway component thereon, and a lower portion which includes an integral pan portion to seatably receive a secondary cover member. The riser pan member further includes an annular ring between the upper and lower portions. The riser pan member can be employed as a lowermost, a highermost, or as an intermediate component in, for example, an access passageway formed of multiple stackable riser members. In addition, the riser pan member may be formed integrally with a stackable riser member.

2 Claims, 22 Drawing Sheets

U.S. PATENT DOCUMENTS

| | | | | |
|---|---|---|---|---|
| 3,134,264 | A | | 5/1964 | Miller |
| 3,230,674 | A | | 1/1966 | Christensen |
| 3,346,230 | A | | 10/1967 | Tolf, jr. |
| 3,385,012 | A | | 5/1968 | Lovegreen |
| 3,596,419 | A | | 8/1971 | Jalbert |
| 3,611,889 | A | | 10/1971 | Levinson |
| 3,772,826 | A | | 11/1973 | Ferver |
| 3,883,005 | A | | 5/1975 | Stevens |
| 3,920,347 | A | | 11/1975 | Sauriol et al. |
| 4,023,590 | A | | 5/1977 | Harris et al. |
| 4,038,789 | A | | 8/1977 | Axgarde et al. |
| 4,089,139 | A | | 5/1978 | Moffa et al. |
| 4,121,390 | A | | 10/1978 | Hall et al. |
| 4,170,853 | A | | 10/1979 | Kohaut |
| 4,187,647 | A | | 2/1980 | Hall |
| 4,188,151 | A | | 2/1980 | Hall |
| 4,197,031 | A | | 4/1980 | Hild |
| 4,410,099 | A | | 10/1983 | de Larosiere |
| 4,472,911 | A | | 9/1984 | Jooris et al. |
| 4,508,469 | A | | 4/1985 | Dumortier |
| 4,508,470 | A | | 4/1985 | Ferns |
| 4,553,876 | A | | 11/1985 | Arntyr et al. |
| 4,593,714 | A | | 6/1986 | Madden |
| 4,659,251 | A | | 4/1987 | Petter et al. |
| 4,663,036 | A | | 5/1987 | Strobl, Jr. et al. |
| 4,759,656 | A | | 7/1988 | Wilson |
| 4,772,154 | A | | 9/1988 | Caroulle |
| 4,828,274 | A | | 5/1989 | Stannard |
| 4,842,443 | A | | 6/1989 | Argandona |
| 4,852,757 | A | | 8/1989 | Gold |
| 4,960,149 | A | | 10/1990 | Rizzitiello |
| 4,978,023 | A | | 12/1990 | Behlmann et al. |
| 4,997,562 | A | | 3/1991 | Warner |
| 4,998,387 | A | | 3/1991 | Geiger |
| 5,038,540 | A | | 8/1991 | Krautz |
| 5,044,818 | A | | 9/1991 | Pritchard |
| 5,046,886 | A | | 9/1991 | Muir et al. |
| 5,076,456 | A | | 12/1991 | Geyer |
| 5,114,271 | A | | 5/1992 | Sunderhaus et al. |
| 5,123,776 | A | | 6/1992 | Lang et al. |
| 5,205,668 | A | | 4/1993 | Adams |
| 5,263,298 | A | | 11/1993 | Ballesteros |
| 5,362,175 | A | | 11/1994 | Begin |
| 5,366,317 | A | | 11/1994 | Solimar |
| 5,385,326 | A | | 1/1995 | Bidwell |
| 5,386,669 | A | | 2/1995 | Almeida |
| 5,470,172 | A | | 11/1995 | Wiedrich |
| 5,513,926 | A | | 5/1996 | Prescott |
| 5,525,006 | A | | 6/1996 | Kilman et al. |
| 5,535,908 | A | | 7/1996 | Sheu |
| 5,542,780 | A | | 8/1996 | Kourgli |
| 5,549,411 | A | | 8/1996 | Hawkins |
| 5,564,855 | A | * | 10/1996 | Anderson ..... 404/26 |
| 5,617,679 | A | | 4/1997 | Meyers |
| 5,653,559 | A | | 8/1997 | Stieb et al. |
| 5,669,523 | A | | 9/1997 | Mueller et al. |
| 5,711,536 | A | * | 1/1998 | Meyers ..... 277/606 |
| 5,852,901 | A | | 12/1998 | Meyers |
| 6,088,972 | A | | 7/2000 | Johanneck |
| 6,195,944 | B1 | | 3/2001 | Goldthorpe |
| 6,393,771 | B1 | * | 5/2002 | Stetson ..... 52/20 |
| 6,484,451 | B1 | | 11/2002 | Gavin |
| 6,655,093 | B1 | * | 12/2003 | Gavin ..... 52/20 |
| 6,688,072 | B1 | * | 2/2004 | Gavin ..... 52/742.14 |
| 6,773,202 | B2 | * | 8/2004 | Hagen ..... 404/25 |
| 2002/0166291 | A1 | | 11/2002 | Campbell et al. |

FOREIGN PATENT DOCUMENTS

| | | |
|---|---|---|
| EP | 0 866 179 | 9/1998 |
| GB | 1 507 106 | 4/1978 |
| GB | 1 599 409 | 5/1978 |
| GB | 2 185 053 A | 7/1987 |
| GB | 2 301 848 | 12/1996 |

OTHER PUBLICATIONS

Digital photos of American Manufacturing Company, Manassas, Virginia, "Distribution Box", "Box Riser" (extension and flange). "Box Riser SL" (extension flange assembled), understood to be on sale at least as early as Jan. 1, 2001.

* cited by examiner

Fig. 28
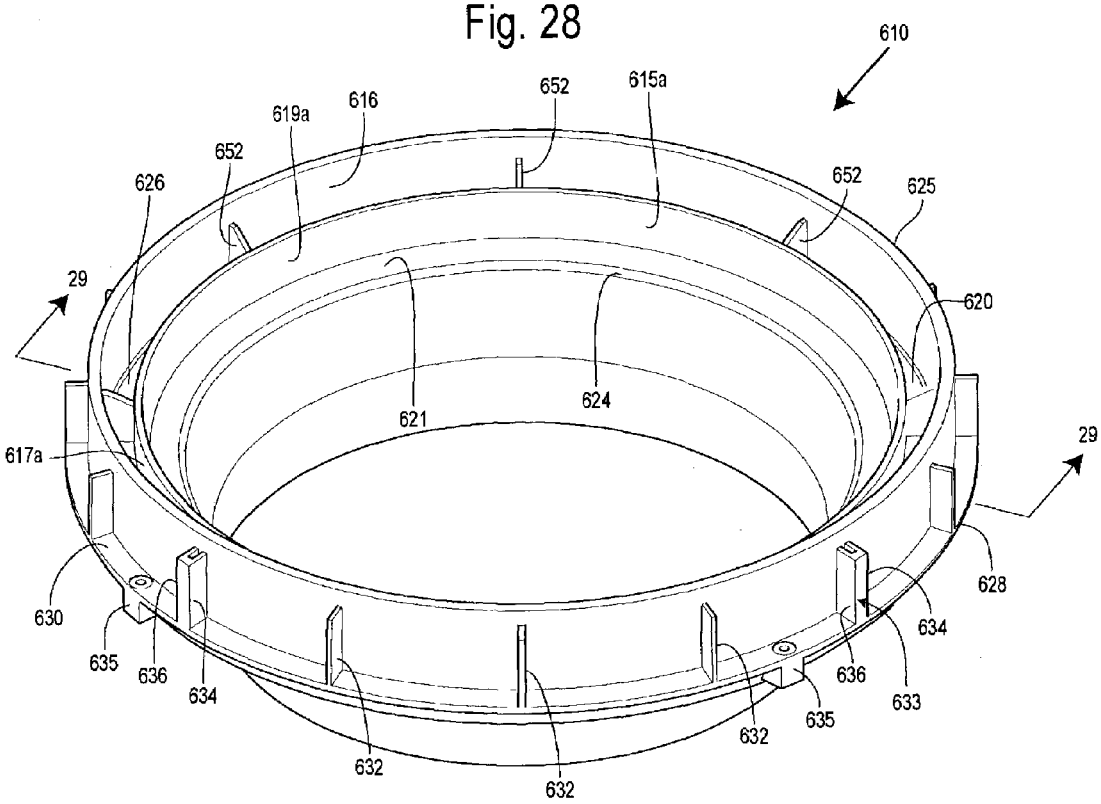
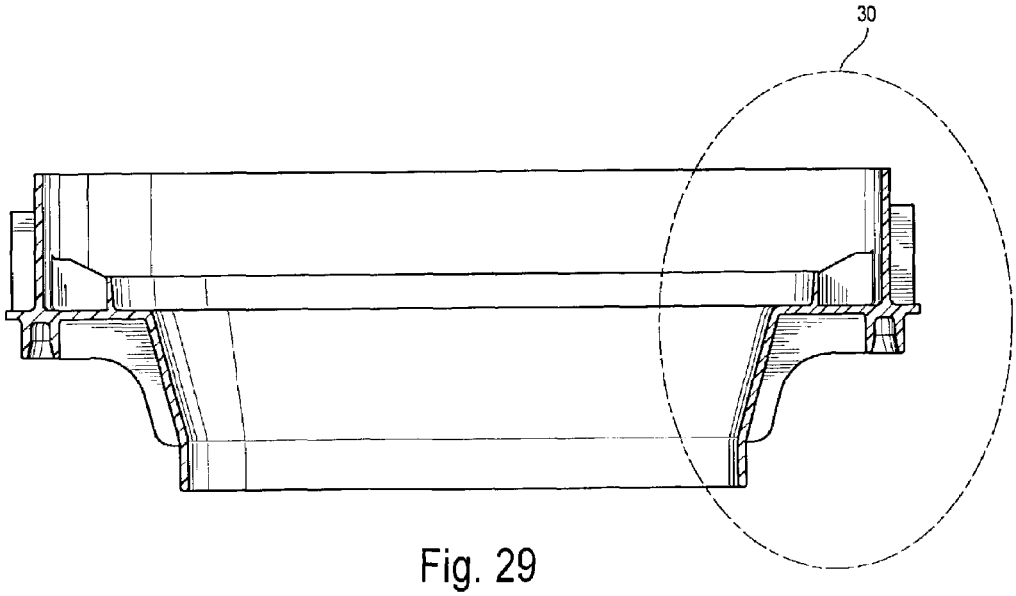
Fig. 29

RISER PAN COMPONENT FOR ON-SITE WASTE SYSTEMS

REFERENCE TO RELATED APPLICATIONS

This disclosure is entitled to the benefit of the filing date of U.S. Provisional Application No. 60/353,620, filed Feb. 1, 2002, as to all subject matter commonly disclosed therein.

BACKGROUND

1. Field of the Invention

This disclosure relates generally to access covers for septic tanks and generally vertical access passageways between a septic tank (or another underground on-site waste disposal system or drainage collection system component) and grade level, and more specifically, to a component for use with (or without) a passageway formed by multiple stackable riser members, which component is capable of being cast into a concrete septic tank top, as well as being stackable with one or more riser members, and removably accepting a concrete or other heavy material cover or inspection lid therein, as well as being adapted to removably accept another cover thereon.

2. Description of the Prior Art

An important consideration in the construction of septic tanks and other underground waste or drainage systems is how to provide water tight access to the buried system components for purposes of periodic maintenance (such as for pumping out a septic tank, which is typically done at least every few years, and in some cases, annually or even more frequently). Often, septic tanks and other underground liquid waste-holding components are provided with precast concrete covers, preferably with lift handles cast therein, in order to gain access to the interior of the septic tank. The concrete cover is typically located in the concrete top section, or lid, of the septic tank.

There have been problems related to the use of make-shift access passage assemblies, such as modified chimney flues made of clay tile or cement, or extended lengths of large diameter pipe (such as smooth-walled PVC pipe, or corrugated or co-extruded pipe), used to form passageways between septic tanks and grade level. In order to overcome problems associated with such make-shift assemblies, a favorable alternative has been developed in the form of durable stackable riser members, as typified by the riser members disclosed in U.S. Pat. Nos. 5,617,679 and 5,852,901, owned by Tuf-Tite, Inc., the assignee of the present invention. Such riser members are typically made of comparatively lightweight, but sturdy material, such as polyethelene. Such injection-molded stackable risers allow for easy adjustment of the overall height of the access passageway, since additional risers can be easily added to increase the height, or risers can be removed to shorten the passageway. In a preferred manner of using these stackable riser members in conjunction with concrete septic tanks, the lowermost riser member is cast directly into the concrete top of the septic tank form. In this manner, perpendicularity of the entire access passageway, formed by a stack of risers, to the top of the septic tank is reliably established and maintained.

As disclosed in U.S. Pat. No. 5,852,901, the riser members can be interconnected by means of a generally inverted U-shaped connecting member or channel provided at a lower end of the riser member, which is adapted to receive a free upper end of a next-lower riser member in a given stack of risers.

It is recognized that later-developed riser members, such as the stackable riser sold by Polylok, Inc. and United Concrete Products, Inc. of Yalesville, Conn., employ variations of technique of interconnection of the riser members disclosed in U.S. Pat. No. 5,852,901. For example, as described in U.S. Pat. No. 6,484,451, the risers employ a channel end and an opposite tapered or straight end. The channel end of the riser member includes a middle wall, with notches or slots at regular intervals therein, defining two concentric channels. In a cylindrical stackable riser of the type disclosed in that patent, the middle wall is essentially an interrupted ring. The outermost channel receives the tapered or straight end of the next-lower stackable riser member, and the inner channel of the channel end, together with the notches in the middle wall of the channel end, receive vertical reinforcing ribs provided on the interior wall of the next-lower stackable riser member.

Access passageways formed by stackable risers, such as those described in U.S. Pat. No. 5,852,901 of Tuf-Tite, Inc., are known to be used in conjunction with an injection molded cover used at grade level. The injection molded cover can terminate a stack of risers by being placed on the uppermost riser in the same manner of interconnection as the other risers, e.g. by an inverted U-shaped channel extending downwardly from the cover.

The cover is secured to the uppermost riser by, for example, securement screws and screws which extend vertically through the cover at its perimeter, and which are received in screw bosses provided around the exterior of the uppermost riser in a stack of risers, all for safety and security reasons. Such covers are preferably provided with additional horizontally-oriented securement screws, screws, or other fasteners, which extend in a direction perpendicular to the vertically-extending securement screws. Instead of being received in screw bosses, these lateral securement screws may abut the upper lip of the uppermost riser which is received in a channel provided in the bottom of the cover, or alternatively, extend through screw holes provided in the upper lip of the uppermost riser in a stack of risers. Even with such securement methods available for the injection-molded covers, there exists a need for an additional cover in the form of a heavy-duty concrete (or other heavy material) secondary cover provided either just below the injection molded cover, i.e. at or near grade level, or alternatively, in or immediately adjacent to the concrete lid of the septic tank, i.e. at or near the bottom of the passageway.

Those of ordinary skill in the art will understand that the term "concrete lid" of the septic tank refers to the large, horizontally-oriented concrete slab, typically on the order of 4 feet by 8 feet, for example, provided at the top of the septic tank having a capacity from about 750 to about 1,250 gallons, and supported by the walls of the septic tank, as opposed to the term "concrete cover", which as used herein, refers to the well-known removable, generally smaller (and typically round) cover member associated with an opening in the concrete lid and used to gain access to the interior of the septic tank. Such concrete covers are generally flat, have cylindrically-shaped outer peripheral walls, while others may be tapered, and may include a stepped portion. The concrete covers sit atop the concrete lid, over the lid's access opening. These concrete covers allow a point of access to the interior of the septic tanks for drainage, cleaning, or other maintenance, including access to effluent filters provided at the inlet or outlet of the septic tank, for cleaning or replacement of the filters. Even in instances where a covered access passageway is provided over the concrete lid of the septic tank, there is a growing need for such secondary concrete or other heavy material covers over the lid's access opening in order to comply with many existing and imminent state and local regulations requiring such covers, as well as for added safety considerations. In those localities where there are no regulations requiring covers of a particular material or weight, it is still beneficial to use an internal cover within a septic tank or other on-site waste system access passageway, even if the cover is made of a lightweight material, such as plastic.

It is recognized that conventional on-site waste system access passageways formed of extended lengths of PVC pipe have been outfitted with plastic or fiberglass covers, often secured to the top of the PVC pipe by screws. However, such arrangements are considered even less secure than the stackable risers with injection-molded covers. Further, the PVC pipe passageways, which typically have smooth inner walls, do not provide any means for accepting and retaining secondary concrete or other heavy material septic tank covers, either at or near grade level, or lower down in the passageway.

One difficulty relating to the use of concrete covers in the lid of the septic tank, especially in combination with such passageways formed by stackable risers, occurs when the concrete cover is cast in place in the concrete lid of the septic tank. Such covers are typically formed in a steel forming pan used repeatedly by a concrete pre-caster, for the sole purpose of casting concrete covers. The installer has little room in which to cast the lowermost riser in place around the pre-cast concrete cover. Due to such space considerations, the casting of a concrete lid for a septic tank with a cast-in lowermost riser is often achieved using several separate pouring operations. First, a lowermost riser is placed on the floor and a steel pan is placed therein. Next, concrete is poured in the space between the outside of the steel pan and the inside of the lowermost riser. After that, concrete is introduced into the inside of the steel pan to form the concrete cover. The steel pan is often frustro-conical in shape, with a lower end having a smaller diameter than the upper end. Before the concrete cover dries, it is desirable to add a cast-in handle, such as the H1 "Cast In Handle" available from the present assignee, Tuf-Tite, Inc., i.e. to the center of the concrete cover to facilitate removal and replacement of the cover. Finally, concrete can be poured to form the concrete lid of the septic tank around the outside of the lowermost riser, thereby encasing and retaining the lowermost riser within that concrete lid.

The concrete cover is removed from the ring of concrete formed in the interior of the lowermost cast-in-place riser, and the steel pan is removed for re-use. Due to the frustro-conical shape of the pan, once the steel pan is removed, the resulting concrete cover has a frustro-conical profile which can then be placed over the complementary concrete ring formed in the interior of the lowermost stackable riser, which serves as a mating angled seat for the concrete cover. There is a tendency for there to be a mis-matched fit, which results in a locking wegde fit between the concrete cover and the complementary concrete ring, which is undesirable.

At least one such stackable riser, such as is available from Tuf-Tite, Inc., includes an interiorly-extending annular ring, which provides some internal support for the concrete interior ring. However, due to the relatively narrow width of the concrete ring within the concrete riser, there is some concern about degradation of the concrete seat for the concrete cover. Over the years, repeated access to the septic tank via the concrete cover may tend to cause chips or cracks in the concrete seat, particularly if people accessing the tank drop the concrete cover in place from any significant height above the top of the septic tank, as is not uncommon due to both the weight of the concrete cover and the depth of some septic tanks.

It would be desirable if the lowermost, cast-in-place riser could also form the mold pan for the concrete cover and also remain in place as the seat for the concrete cover when the concrete septic tank lid is installed underground on a septic tank. This approach would advantageously avoid the need for a separate steel form pan, reduce the number of pouring operations during casting, and add reliability to the resulting seat for the concrete cover. The manner in which these and other benefits of the present invention are achieved will be explained in greater detail in the following Detailed Description of the Invention and the drawings.

DESCRIPTION OF THE DRAWINGS

FIG. 28 is a perspective view of a riser pan of a seventh embodiment of the present invention;

FIG. 29 is a cross-sectional view of the riser pan shown in FIG. 28, taken along lines 29-29 of FIG. 28.

DETAILED DESCRIPTION OF THE INVENTION

Figure 1:
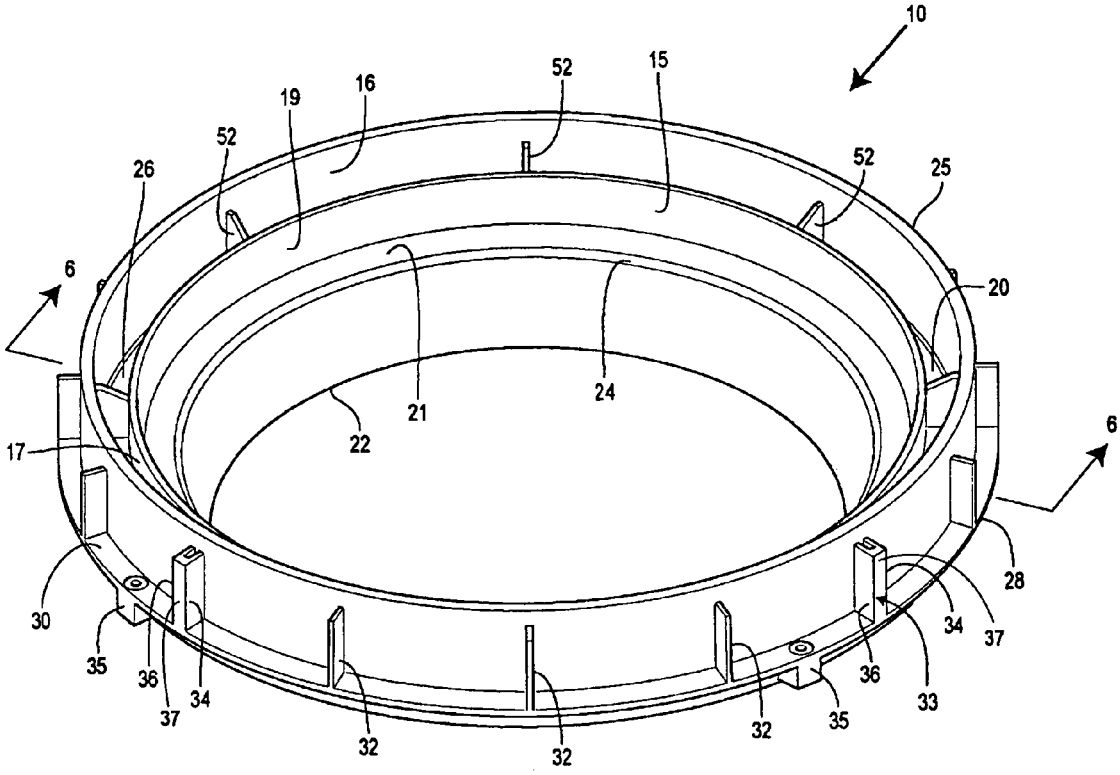
FIG. 1 is a perspective view of a riser pan of a first embodiment of the present invention.

A first embodiment of a riser pan 10 for use in conjunction with an access passageway formed of stackable, interconnecting risers 12, 14 is shown in FIGS. 1-10. In a preferred embodiment, the riser pan 10 takes the form of an injection-molded cylindrical member made of high density polyethylene. More specifically, the riser pan 10 includes an upper cylindrical wall 16, a lower pan portion 18, and an intermediate, generally flat annular ring 20. The pan portion 18 is preferably frustro-conical, has a lowermost edge 22 and an upper end 24. The frustro-conical pan portion 18 is tapered inwardly, such that its diameter at the lowermost edge 22 is less than at the upper end 24. In a preferred embodiment of the riser pan 10, the degree of taper of the pan portion 18 is in the range of between approximately 0° and 45°, and preferably about 14.796° for a 24" riser pan, but those of ordinary skill in the art will appreciate that an even wider range of angles for the taper are possible, and even varying angles within the length of the taper so as to impart a curvilinearly-profiled surface to the frustro-conical pan portion 18, and all are within the scope of the present invention. While the incline of the frustro-conical pan portion 18 preferably extends substantially the entire height of the pan portion 18, alternatively, and also within the scope of the present invention, the pan portion 18 could include both generally vertical and generally inclined portions so as to form a stepped profile within the pan portion 18. In the event a stepped profile is employed, it is further recognized that the degree of incline of the inclined portions may differ from one another to facilitate removal of a cover cast within the riser pan, among other benefits.

Figure 9:
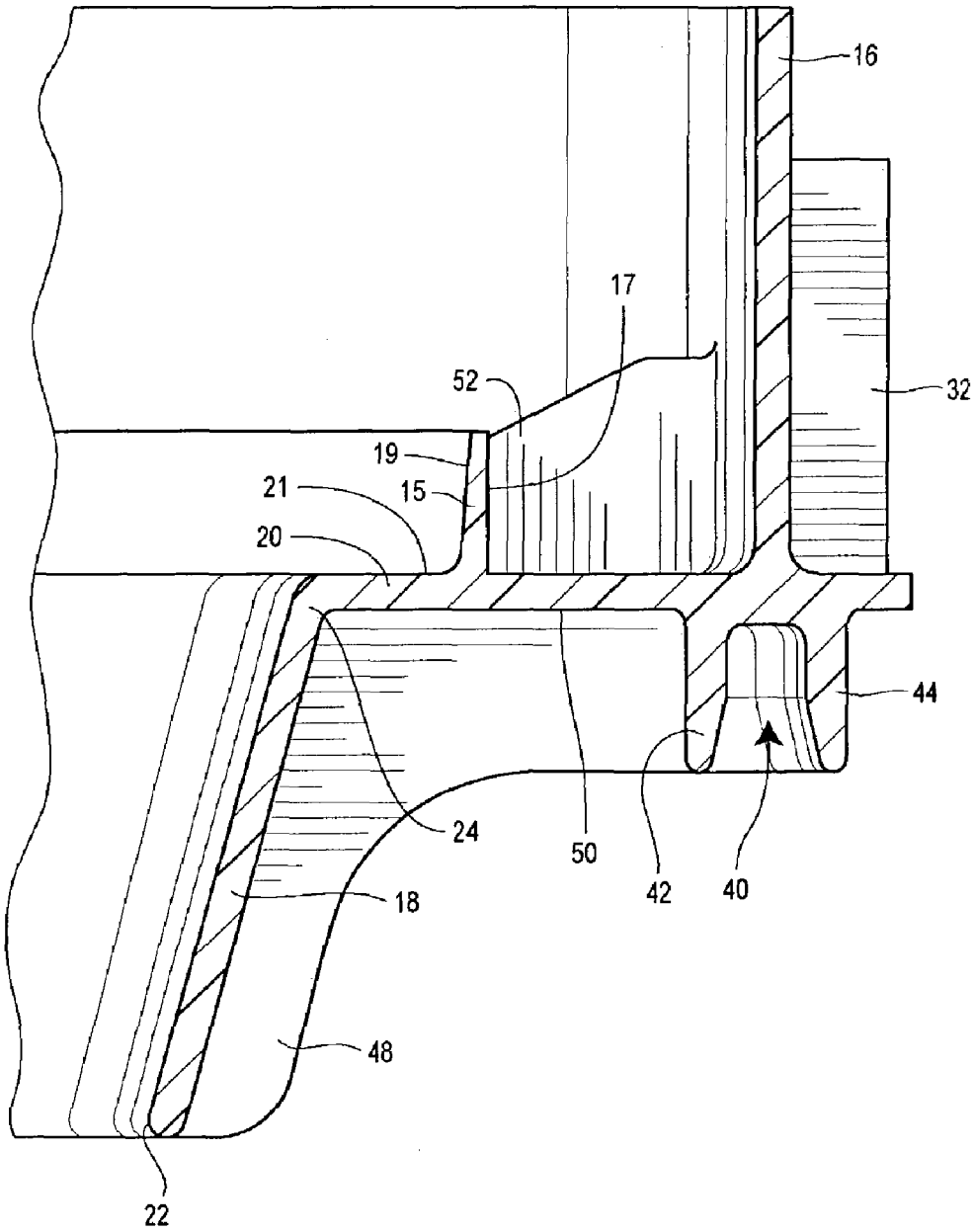
FIG. 9 is an enlarged cross-sectional view, broken away, taken along circular line 9 in FIG. 6, of the riser pan of FIGS. 1-8.

Preferably, as best seen in FIGS. 1 and 9, the riser pan 10 is provided with a standing circular rib 15 having a generally vertical outer surface 17 and an inner surface 19 that is preferably slightly tapered or inclined. Inasmuch as the standing circular rib 15 allows a concrete or other material cover to have a stepped profile, as discussed below, the degree of taper of the pan portion 18 may be 0° without causing the cover to fall through pan portion 18. The degree of incline of the inner surface 19 of the standing circular rib 15 is preferably in a range of about 0° (i.e., vertical) to about 5° from vertical with respect to the generally flat annular ring 20 of the riser pan 10. However, it is recognized that other degrees of incline for inner surface 19 are possible. The preferred subtle incline to the inner surface 19 of the standing circular rib 15 advantageously facilitates proper centering and alignment of a concrete or other heavy material cover 58 (see FIG. 7; discussed in more detail below). It is recognized that while the internal cover 58 disclosed herein is described as being made of concrete or other heavy material, it is also within the scope of the present invention to use an internal cover made of a lightweight material, such as injection molded plastic.

The portion of the generally flat annular ring 20 between the upper end 24 of the frustro-conical pan portion 18 and the standing circular rib 15 provides a circular, generally flat, step 21. In those applications in which a cover 58 is taller than the frustro-conical pan portion 18, i.e. where the cover 58 extends further up into the region of the riser pan 10 defined by the standing circular rib 15, the step 21 advantageously provides a generally flat interface between the cover 58 and the riser pan 10. Inasmuch as obtaining a water-tight seal is significantly more difficult between inclined, as opposed to flat, surfaces, it is preferable that any means for providing or enhancing a water-tight seal between the riser pan 10 and the cover 58 be accomplished in the area of the step 21.

For example, an O-ring or generally flat annular sealing ring gasket 61 may be provided on the step 21 to form a substantially water-tight seal between the riser pan 10 and a cover 58 received therein. By way of example only, the inner side 19 of the standing circular rib 15 may be horizontally spaced anywhere from ¼-inch from the upper end 24 of the frustro-conical pan portion 18 to a location ¼-inch inwardly from the outer wall, and the standing circular rib 15 may have a height of ½-inch to 1 inch, preferably ¾-inch, but may be made taller or shorter, if desired, by the manufacturer. The standing circular rib 15 may also be spaced closer to or farther from the upper end 24 of the frustro-conical pan portion 18, if desired by the manufacturer.

The generally flat annular ring 20 preferably extends radially outwardly from the upper end 24 of the frustro-conical pan portion 18 past a lower end 26 of the upper cylindrical wall 16, and terminates at an outer edge 28 which is outside the upper cylindrical wall 16. Thus, an annular ledge 30 is provided around the exterior of the lower edge 26 of the upper cylindrical wall 16, which, in this first embodiment, co-extends with the surface provided inside the upper cylindrical wall 16 by the generally flat annular ring 20. The upper cylindrical wall 16 terminates at an upper end 25.

Figure 2:
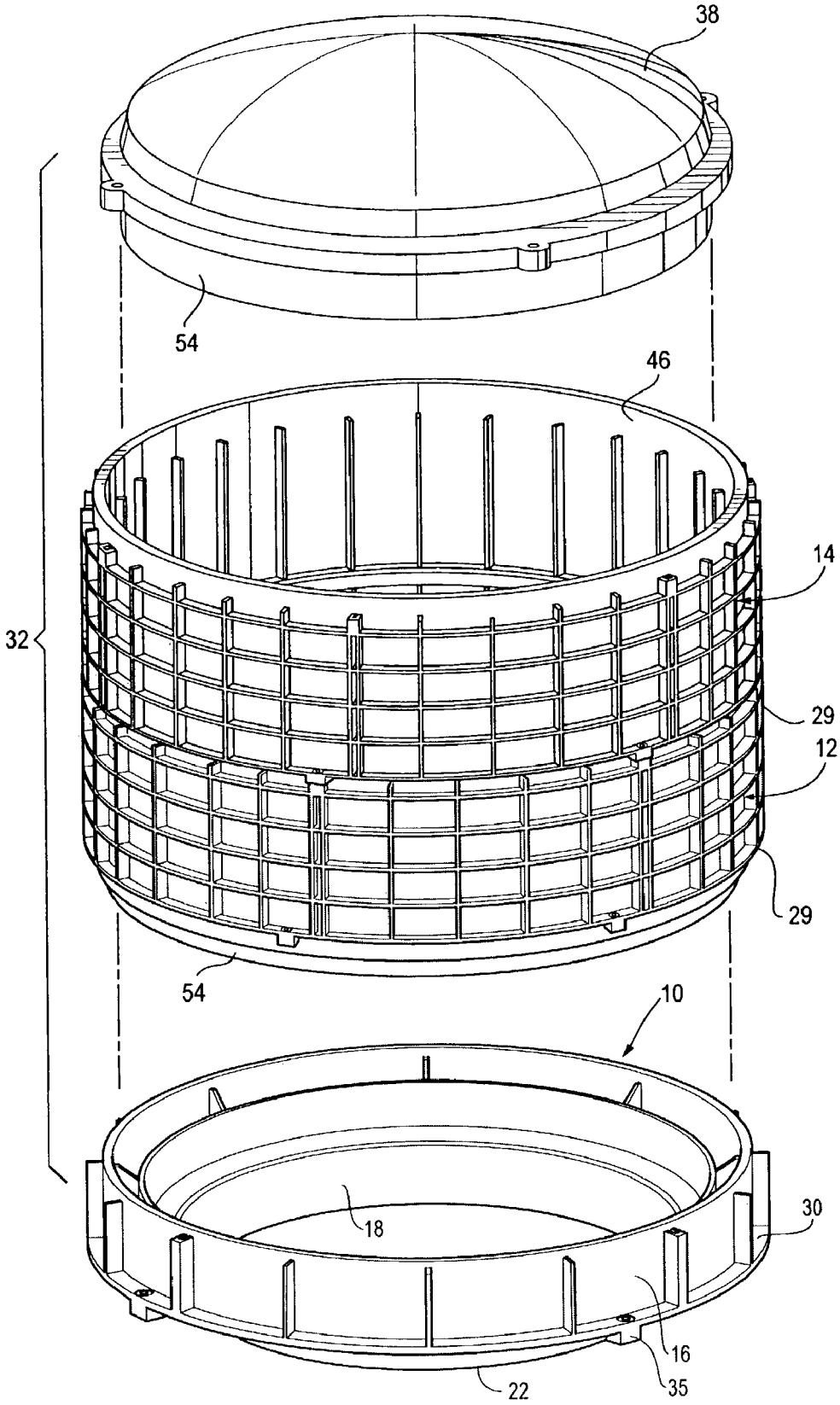
FIG. 2 is a perspective, partially exploded view of the riser pan shown in FIG. 1, in combination with a pair of stackable risers and a cover for use at grade level.
Figure 3:
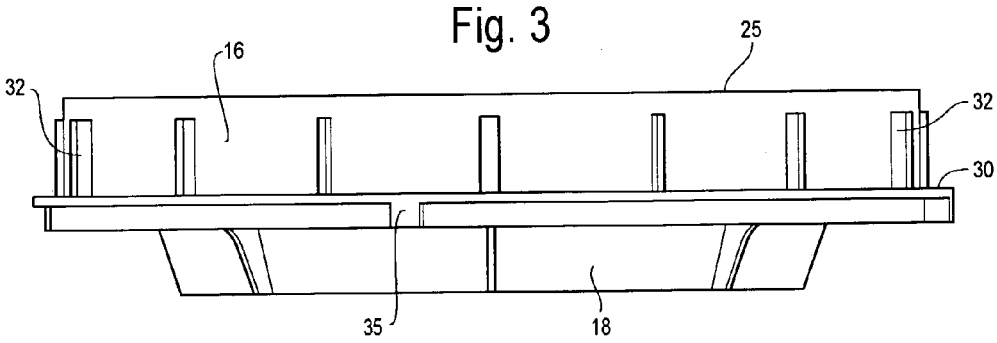
FIG. 3 is a front elevation view of the riser pan shown in FIG. 1.
Figure 10:
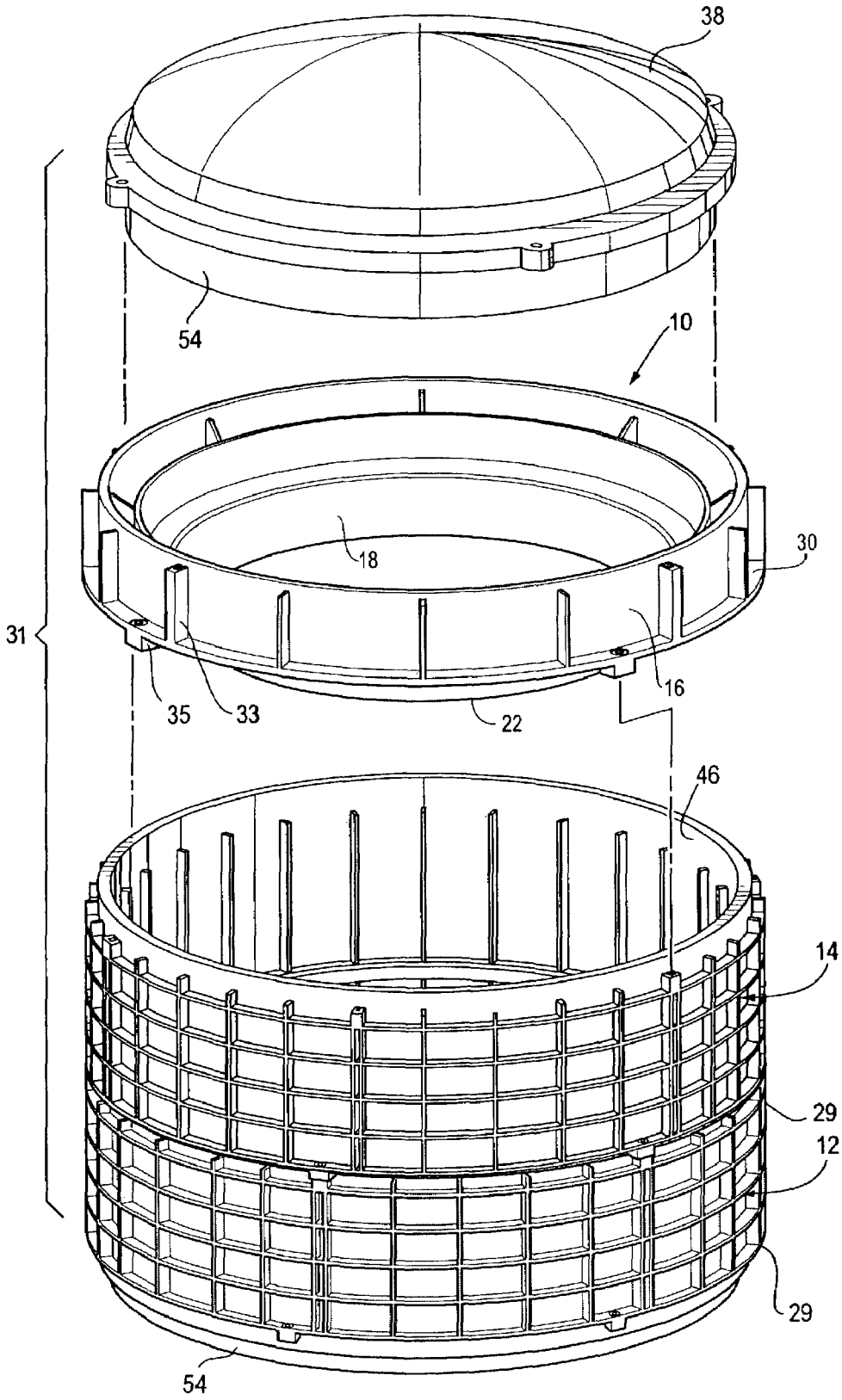
FIG. 10 is a perspective, partially exploded view of a riser pan of the type shown in FIG. 1, in combination with a pair of stackable risers and a cover for use at grade level, depicting placement of the riser pan in an alternate position (i.e. higher in a stack of risers than is shown in FIG. 2)
Figure 11:
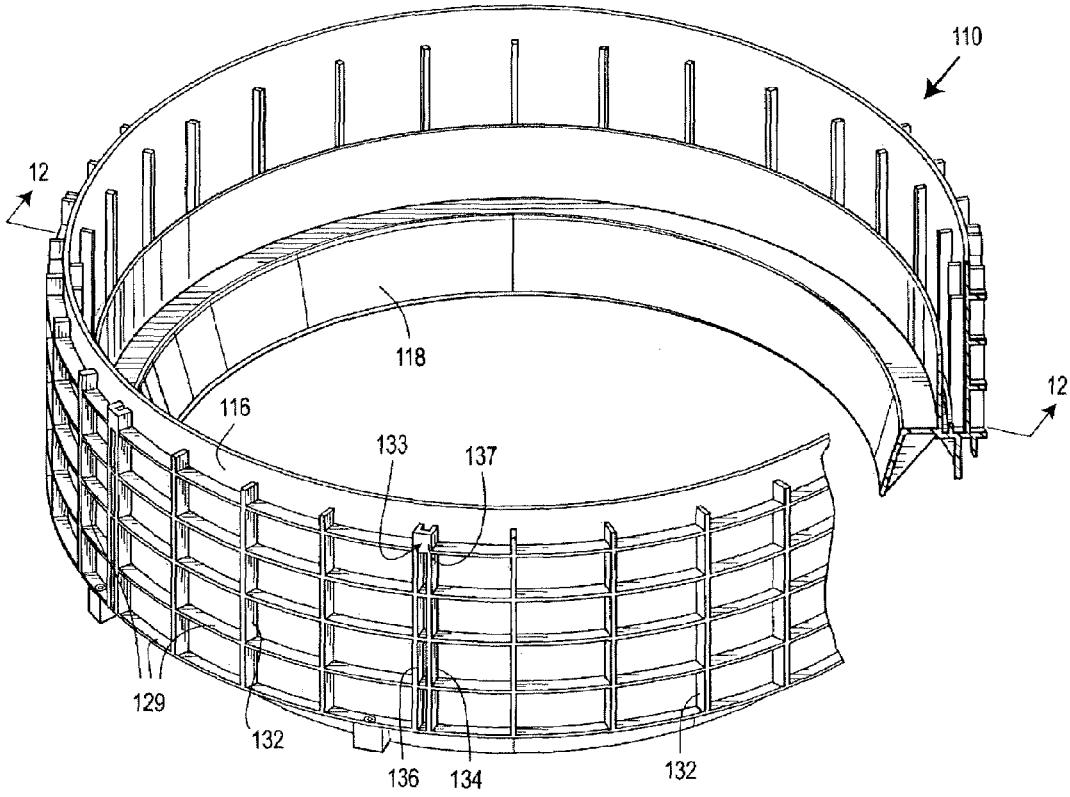
FIG. 11 is a perspective view, partially broken away, of a second embodiment of the riser pan, wherein the riser pan is formed as an integral part of a stackable riser member.

The annular ledge 30 provides a useful gripping portion for use during installation of the riser pan 10 when placed onto a passageway 31 of stackable risers 12, 14 (see FIG. 2) at a location other than its most preferred cast-in location at the concrete lid section of the septic tank. Also, while being buried in the ground as part of such a passageway 31 formed, at least in part, by stackable risers 12, 14 and the riser pan 10, the backfill (not shown) rests upon the annular ledge 30 to help hold the riser pan 10 in its position relative to the stackable risers 12, 14, thereby improving the lateral stability of the entire passageway 31. Furthermore, the backfill also tends to exert downward loads on the annular ledge 30, which tends to push the riser pan 10 down toward other stackable risers (not shown in FIG. 2) that are interconnected in the passageway beneath the riser pan 10. As discussed in U.S. Pat. No. 5,852,901, which is incorporated herein by reference, the stackable risers 12, 14 are provided with horizontal, outwardly-extending annular ledges 29, which provide a similar function. As seen in FIGS. 2 and 10, the stackable risers 12, 14 may each include a plurality of such outwardly-extending annular ledges 29, as the ledges 29 advantageously improve rigidity of the risers 12, 14, and thereby increase the rigidity of the entire passageway 31.

This first embodiment of the riser pan 10 further includes a plurality of exterior, vertically-oriented ribs 32 extending above the annular ledge 30 along the outside of the upper cylindrical wall 16, which are provided to help distribute load transmitted to the riser pan 10 from a next-higher riser 12 stacked thereon. In addition to the ribs 32, several screw bosses 33, each having sidewalls 34, 36, an inner wall defined by an outer portion of the upper cylindrical wall 16, and an outer wall 37, are provided at periodic locations about the upper cylindrical wall 16, which also extend above the annular ledge 30. These screw bosses 33 may take the form of a pair of closely-spaced ribs which are adapted to securely receive a threaded screw therebetween, but it is preferred that the screw bosses 33 be enclosed on the bottom and sides thereof, so as to prevent dirt or, more importantly, concrete (when the riser pan 10 is cast into a concrete septic tank lid), from entering the screw bosses 33 and obstructing the screw-receiving opening therein. Preferably, the screw bosses 33 may be hollow cylindrical or, in the embodiment shown, substantially rectangular hollow polygonal members. The purpose of such screw bosses 33 is to enable securement of an injection molded polyethelene riser cover 38 directly to the top of the riser pan 10 or riser 12, 14, if it is desired to place a riser pan 10 at or near grade level, i.e. at the top of a passageway 31, as shown in FIG. 10. The screw bosses 33 need not be internally threaded to facilitate securely receiving a threaded screw therein, inasmuch as the opening within the screw bosses 33 is sized so as to become self-threading, i.e. the threads of the securement screws will cut into the interior walls of the screw bosses 33 upon initial securement of the molded cover 38 thereon.

Additional screw bosses 35 are also preferably provided, which are spaced apart from the screw bosses 33. These additional screw bosses 35 extend downwardly from the annular ledge 30. Like the screw bosses 33, these additional screw bosses 35 are preferably enclosed, aside from the screw-receiving bore therein, to prevent dirt or concrete from interfering with or corroding a screw (not shown) received in the additional screw boss 35. Because the additional screw bosses 35 are spaced from the screw bosses 33, it will be recognized that screw bosses 33 will also be out of alignment with screw bosses 33*r* of an adjacent riser 12 to which the riser pan 10 is secured, as shown in FIG. 10. Instead, the screw received in the additional screw boss 35 is received in the screw boss 33*r* aligned with the additional screw boss 35.

Figure 7:
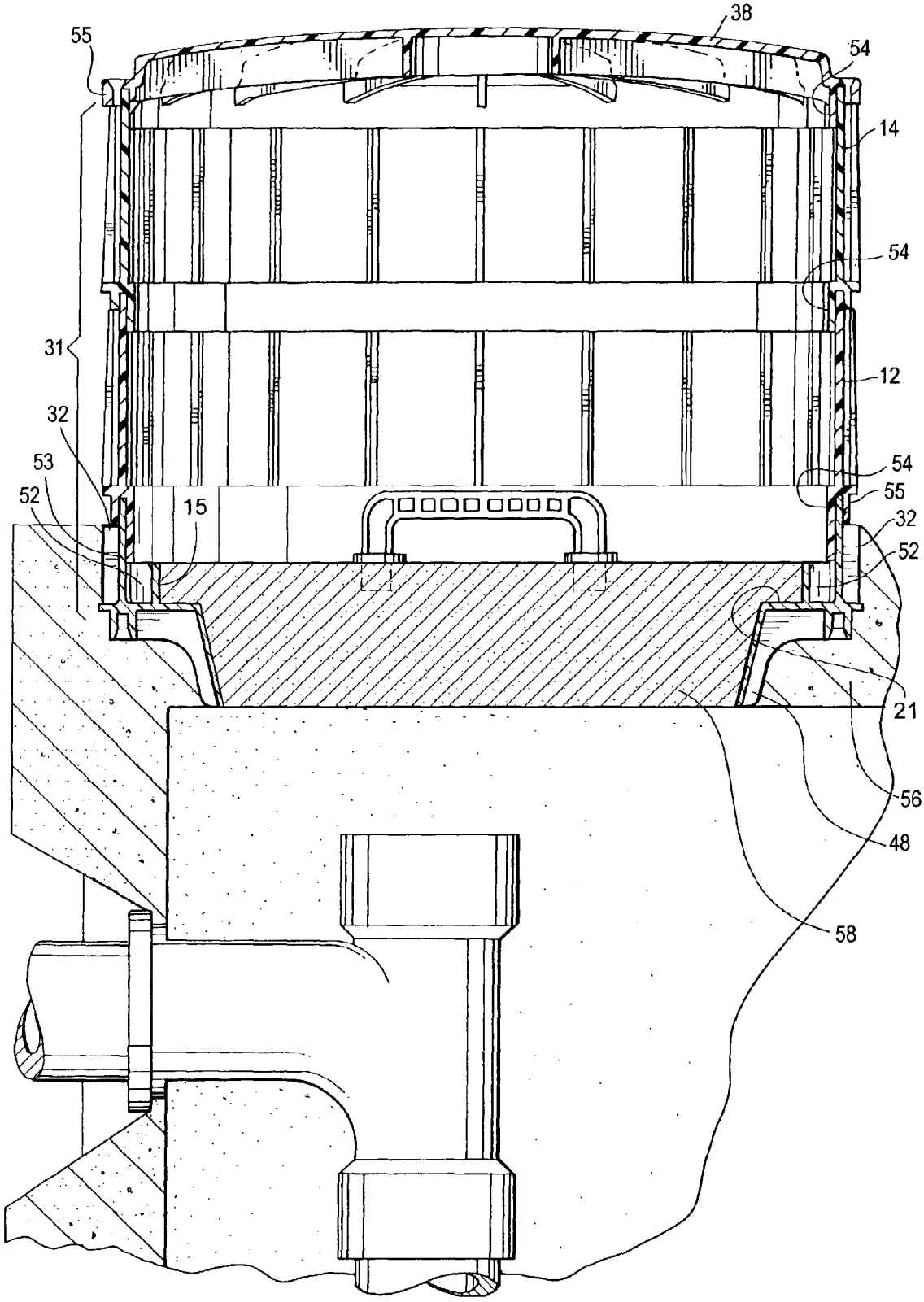
FIG. 7 is an environmental cross-sectional view of the riser pan, stackable riser, and cover combination shown in FIG. 2, with the riser pan cast into a concrete lid of a septic tank, and showing a cross section of a concrete cover received in the riser pan.
Figure 8:
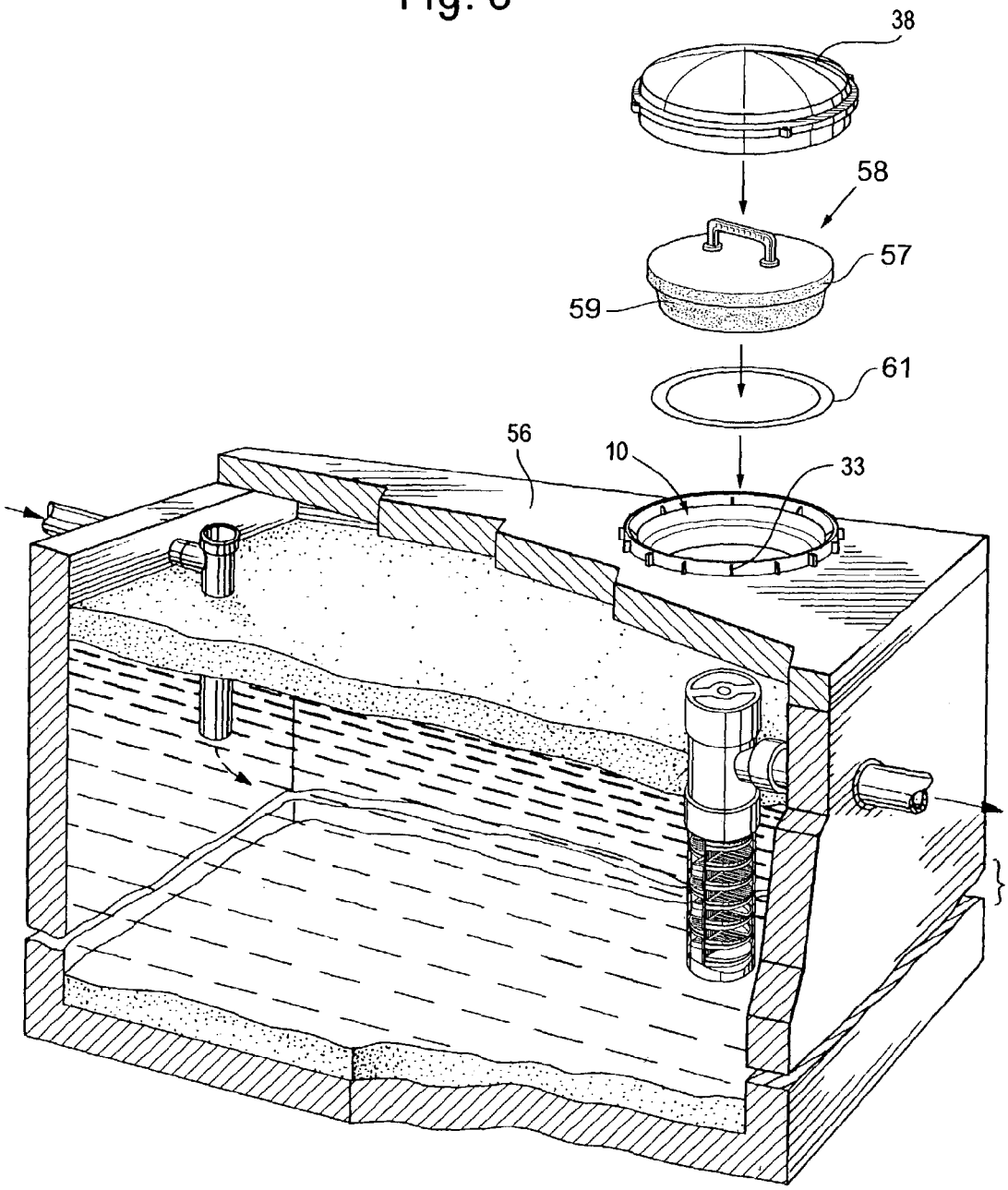
FIG. 8 is a perspective environmental view, partially broken away and exploded, of a riser pan of the type shown in FIG. 1, cast-in-place into a concrete lid of a septic tank, and positioned over the outlet port of the septic tank, and without any additional riser components, but with an injection-molded cover for the riser pan, a concrete cover to be received in the riser pan, and a sealing gasket to be received between a flat portion of the concrete cover and a flat portion of the riser pan to form a substantially liquid-tight seal between the concrete cover and the riser pan.

It is recognized that there are often instances where a septic tank may be buried such that its concrete lid is just below grade level. As shown in FIG. 8, the riser pan 10 advantageously facilitates the use of two covers, one being the injection-molded cover 38 secured to the top of the upper cylindrical wall 16 of the riser pan 10, and the other being a cover 58 (shown in FIG. 7) made of concrete (or some other heavy material) fitting within the frustro-conical pan portion 18, in such applications where there is essentially no room for the use of access passageways such as those formed by the use of multiple interconnected stackable risers 12, 14. When the cover 58 is made of concrete, which is typically the case, such a concrete cover 58 may advantageously be cast directly in the riser pan 10, thereby avoiding the need for a separate mold for casting the concrete cover 58. It is recognized that there are applications in which the concrete or other heavy material cover 58 is adequate, and no external injection molded cover need be used.

Figure 4:
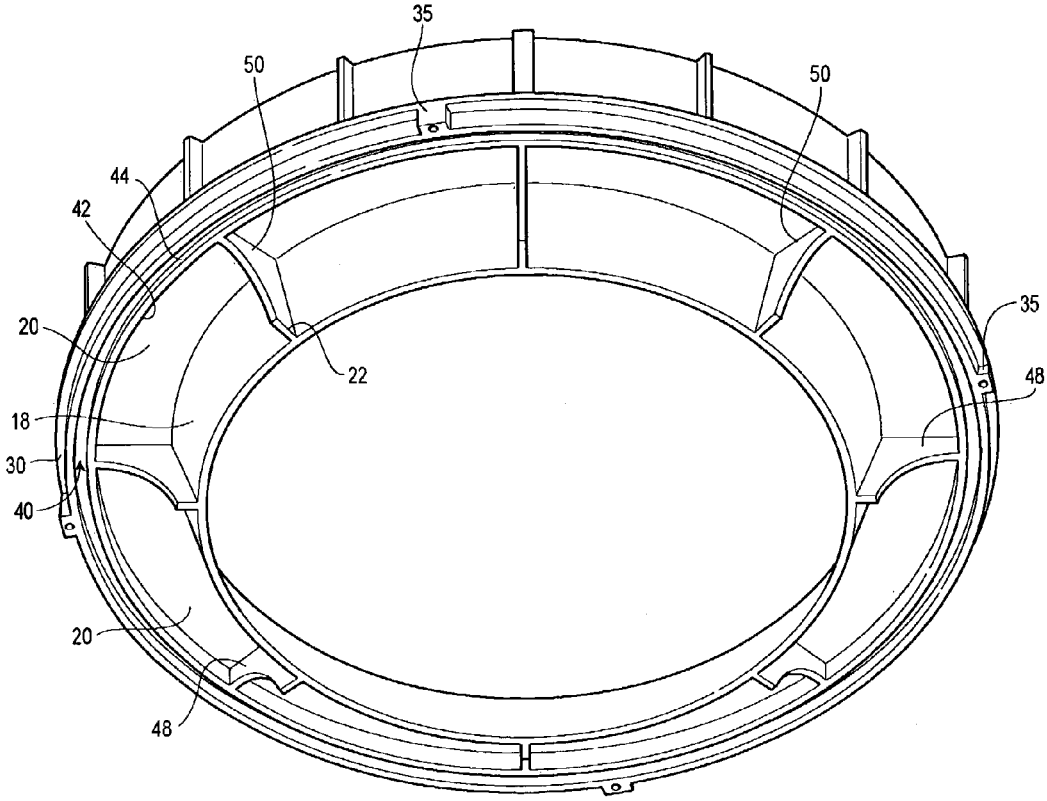
FIG. 4 is a bottom perspective view of the riser pan shown in FIG. 1.
Figure 5:
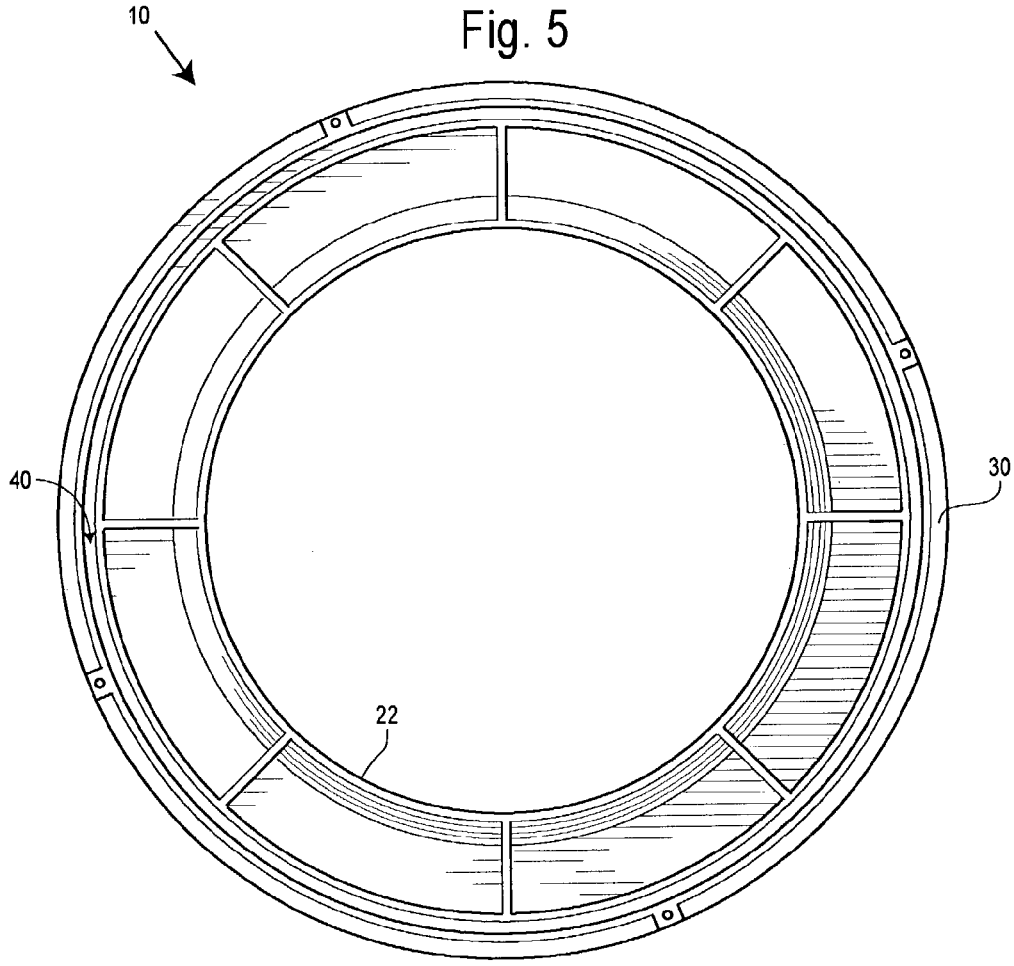
FIG. 5 is a bottom plan view of the riser pan shown in FIG. 1.
Figure 6:
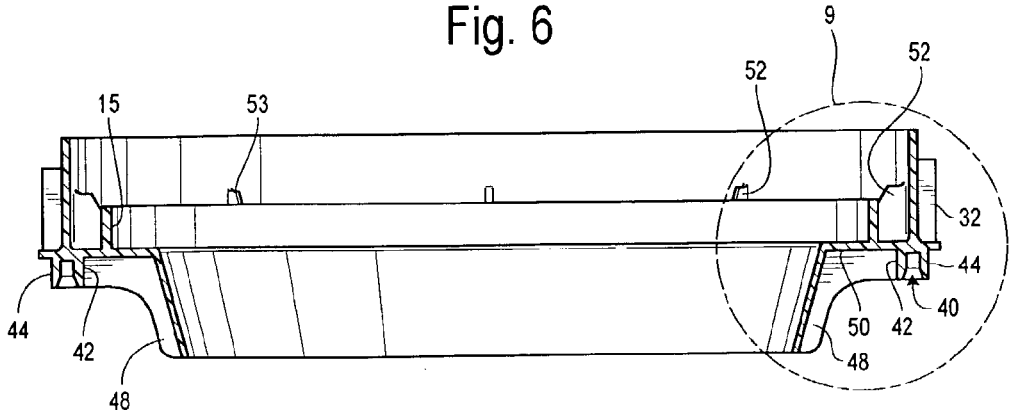
FIG. 6 is a cross-sectional view of the riser pan shown in FIG. 1, taken along lines 6-6 of FIG. 1.

As best shown in FIGS. 4, 6 and 9, the underside of the riser pan 10 includes a channel 40, generally of an inverted U-shape in cross-section, which extends downwardly from the generally flat annular ring 20 and ledge 30. The channel 40 has legs or sidewalls 42, 44, which extend generally about the entire periphery of the riser pan 10. As described in more detail in certain other embodiments discussed below, it is recognized that these legs or sidewalls 42, 44, while preferably continuous to provide optimum water tightness, could be interrupted legs or sidewalls without departing from the scope of the present invention. The channel 40 may be advantageously sized to receive an uppermost male edge 46 of a complementary riser 14, in applications where it is desired to stack the riser pan 10 higher in a passageway 31, rather than the riser pan 10 being cast, as at a lower level, into the concrete septic tank lid 56.

It is recognized that the sidewalls 42, 44 of the channel 40 may alternatively be spaced apart any desired distance by the manufacturer, so as to accommodate more conventional access passageway components, such as corrugated pipe or smooth-walled PVC pipe of a given diameter. Thus, the riser pan 10 of the present invention can be used to cap off existing access passageways or flutes with both an injection-molded, securely screwed riser cover 38, and also accommodate a secondary concrete cover just below grade level, as may be highly desirable to increase the safety of existing septic tank installations. It can be used as well to bring (i.e., retrofit) such existing in-ground waste systems into compliance with newer state and/or local regulations requiring multiple covers to septic tank access openings.

Another application wherein the riser pan 10 may be used to retrofit an existing access passageway is a passageway 31 formed by a plurality of stackable risers. A homeowner desiring to install a secondary cover would simply remove the uppermost riser 14 of the existing access passageway and replace it with a riser pan 10. The riser pan 10 would accommodate both a concrete or other heavy material cover 58 in its frustro-conical pan portion 18, as well as a securely-screwed injection molded outer primary cover 38 on its upper cylindrical wall 16. Yet another potential application for the riser pan 10 is in an access passageway formed entirely of cylindrical concrete segments. Advantageously, one could cast the riser pan 10 such that it is sandwiched between two cylindrical segments within the passageway, i.e. two risers 12, 14, thus providing a means, by way of the frustro-conical pan portion 18 of the riser pan 10, to use a secondary concrete or other heavy material cover 58 at a desired height within the access passageway.

Most preferably, the sidewalls 42, 44 of the inverted, U-shaped channel 40 are of equal length, i.e. height, to one another. It is found that, when casting the riser pan 10 into the concrete form of the septic tank lid, concrete can flow horizontally when riser pan 10 sits on top of the concrete lid form for the septic tank. This allows the concrete to fill any voids under the inverted, U-shaped channel 40. Alternatively, if the sidewalls 42, 44 were of different heights, for example if the inner sidewall 42 were taller than the outer sidewall 44, the concrete would have difficulty flowing around the inner sidewall 42, and there would most likely be undesirable voids left between the riser pan 10 and the concrete lid of the septic tank. Also, with a taller internal sidewall 42, there is less even distribution of vertical loads coming down through the passageway 31.

FIG. 4 also shows the presence of additional ribs or gussets 48, which are preferably provided at regular intervals, in this first embodiment of the riser pan. These gussets 48 extend from the inner sidewall 42 of the channel 40, along the underside of the generally flat annular ring 20, and down along the outside of the frustro-conical pan portion 18, terminating at the lowermost edge 22 of the frustro-conical pan portion 18. The gussets 48 help maintain the rigidity of the frustro-conical pan portion 18, and increase the stability of the frustro-conical pan portion 18, which is advantageous inasmuch as the frustro-conical pan portion 18 is intended to support a secondary concrete or other heavy material septic tank cover 58 therein. It is recognized that the septic tank cover 58 may be made of a suitably strong material other than concrete, although concrete is, desirable for its weight and is an approved material for use as a septic tank cover in many jurisdictions.

In order to provide even additional stability to the frustro-conical pan portion 18 for the riser pan 10, it will be appreciated by those of ordinary skill in the art that the gussets 48, which appear in FIG. 4 to terminate at a flat edge 50 along the bottom of the generally flat annular ring 20, actually extend above the generally flat annular ring 20. Turning back to FIG. 1, there can be seen a plurality of gusset extensions 52, disposed in the embodiment shown in 45° intervals, which extend from the gussets 48 directly opposite each respective gusset extension 52 on the opposite side of the generally flat annular ring 20. These gusset extensions 52, which extend up the inside of the upper cylindrical wall 16 and terminate along the outside of the standing circular rib 15, help distribute loads exerted on the frustro-conical portion to the upper cylindrical wall 16. The gusset extensions 52 also reinforce the standing circular rib 15; the extensions 52 advantageously help resist damage to the standing circular rib 15 as a heavy cover 58 is repeatedly inserted in and removed from the riser pan 10.

The gusset extensions 52 may be further reinforced by the vertically oriented ribs 32, some of which are directly opposite the upper cylindrical wall 16 from respective gusset extensions 52. Advantageously, the gusset extensions 52 are preferably each provided with a flat top 53 (see FIGS. 6 and 7), which can accommodate, and thereby help support, an inner sidewall 54 of an inverted generally J-shaped channel extending downwardly from either a stackable riser 12, 14 or a cover 38. That is, the vertically oriented ribs 32 on the outside of the upper cylindrical wall 16 preferably terminate, in this first embodiment of the riser pan, an appropriate distance from the upper end 25 of the upper cylindrical wall 16, so that the outer sidewall 55 of the J-shaped channel of either a stackable riser 12, 14 or cover 38 rests thereon. (See FIG. 7) Thus, the flat top 53 of the gusset extensions 52, the upper end 25 of the upper cylindrical wall 16, and the tops of the vertically oriented ribs 32 all preferably cooperate to distribute vertical loads imparted to the riser pan 10 from stackable risers 12, 14 and/or the molded riser cover 38. The U-shaped channel 40 of the riser pan 10 also enables multiple riser pans 10 to be vertically nested together for storage, shipping, or retail display, and alternatively, to be nested with and between riser members 12, 14 at any desired location within the stack.

Advantageously, several riser pans 10 may be cast into a single concrete septic tank lid 56 at different locations therein. For example, one of the riser pans 10 (not shown in FIG. 8) can be cast into the concrete tank lid 56 such that it is positioned over the septic tank inlet, a second riser pan 10 can be cast into the concrete lid 56 over the outlet of the septic tank (as shown in FIG. 8), and, for optimal access and so as to facilitate pumping out the septic tank, a third riser pan 10 (also not shown in FIG. 8) could additionally be cast into the concrete lid 56 so that it is generally centrally positioned over the septic tank to provide interior access.

Typically, the concrete lid 56 of a septic tank has a thickness in a range from about 2½ inches to about 4½ inches. It will be recognized that neither the overall height of the riser pan 10, nor the height of the screw bosses 33, need to constitute a limit on the thickness of the concrete lid 56 into which the riser pan 10 can be cast. In the event one desires to cast a riser pan 10 into a concrete septic tank lid 56 of greater thickness than the height of the screw bosses 33, an appropriately-sized shim (not shown), made, for example, of wood or foam, can be placed beneath the riser pan 10 during casting so as to raise the riser pan 10 a desired distance, such that the top of the screw bosses 33, if desired, can be kept level with, or higher than, the top of the concrete septic tank lid 56. It will be recognized that in such an installation, the resulting concrete cover 58 would have the thickness of the frustro-conical section of the riser pan 10, so the concrete cover 58 would not necessarily extend completely to the bottom of the concrete tank lid 56.

When casting the riser pan 10 into a concrete tank lid 56, the tops of the screw bosses 33 are exposed, so that an injection-molded cover 38 can be securely screwed directly to the riser pan 10, as would occur once the injection molded cover 38 shown in FIG. 8 is seated on the top of the cast-in-place riser pan 10. This is particularly desirable in instances where, as discussed above, the concrete septic tank lid 56 is just below grade level, so that two covers 38, 58 can be used with such a septic tank. However, even in instances where the septic tank is deeply buried, and there is an elongated access passageway 31 formed of multiple stackable risers 12, 14, it is still desirable to have the screw bosses 33 exposed, inasmuch as there may, for example, become a need to remove the passageway 31, leaving the septic tank buried, and it would be desirable to cap-off the septic tank with both a concrete cover 58 and an injection-molded cover 38 prior to filling in the hole left by the removed components which formed the passageway 31.

It is also preferable to cast the concrete cover 58 so as to not only fill the frustro-conical pan portion 18, but also to fill (at least partially, but preferably, completely) the slightly higher region of the riser pan 10 bounded by the inner surface 19 of the standing circular rib 15. As shown in FIGS. 7 and 8, the resulting concrete cover 58 has a double-tiered shape having an upper tier 57 that is complementary to the region of the riser pan 10 bounded by the inner surface 19 of the standing circular rib 15 (which, as indicated above, is at least slightly inclined) and the step 21, and then a lower tier 59 that is complementary to the frustro-conical pan portion 18. The essentially stepped, double-tiered shape of the concrete or other heavy material cover 58 advantageously assists in preventing the cover 58, once removed from the riser pan 10, from being crookedly placed back into the riser pan 10, and from being taper-locked within the pan portion 18. The incongruity between the relatively shallow slope of the peripheral edge of lower tier 59 of the cover 58 and the relatively steep slope of the inner surface 19 of the standing cylindrical rib 15, together with gravitational forces, tend to direct the lower tier 59 of the concrete or other heavy material cover 58 into a proper alignment and position within the frustro-conical pan portion 18, thereby repeatedly facilitating proper centering and positioning of the concrete or other heavy material cover 58 within the riser pan 10. In instances where an O-ring or annular sealing gasket 61 is provided on the step 21, the proper centering and positioning of the cover 58 within the riser pan 10 improves the integrity of the liquid-tight seal between the cover 58 and the riser pan 10. Alternatively, a sealing tape, a sealing caulk bead, or other suitable sealing means may be used on the step 21 to achieve a substantially liquid-tight seal between the cover 58 and the riser pan 10.

The diameter of the passageway 31, which would preferably be equal to the diameter of the upper cylindrical wall 16, and the diameters of the openings at the lowermost edge 22 and upper end 24 of frustro-conical pan portion 18 of the riser lid 10, are all determined by the manufacturer. For example, riser pans 10 may be made with outer diameters of 16 inches, 20 inches, and 24 inches (as these are diameters commonly used in existing cylindrical stackable risers), with corresponding diameters of the respective opening at the lowermost edge 22 of the frustro-conical pan portion 18 being in a range from approximately 12-13 inches, 16-17 inches, and 20-21 inches. The riser pan 10 may have an overall height of about 5 inches, or some other height as selected by the manufacturer, with the height of the upper cylindrical wall 20 being approximately 3 inches, and the height of the frustro-conical pan portion being approximately 2 inches (both given for 5 inch high riser pans, for example).

The upper end 24 of the frustro-conical pan portion in this first embodiment of the riser pan is, for example, spaced 2½ inch from the lower end 26 of the upper cylindrical wall 16. Each of the screw bosses 34, 36 is spaced, in this first embodiment shown, for example, ½ inch from the upper end 25 of the cylindrical wall 16, such that the height of the top of each of the screw bosses 33 is, for example, 4½ inches, as measured from the lowermost edge 22 of the frustro-conical pan portion 18.

Figure 12:
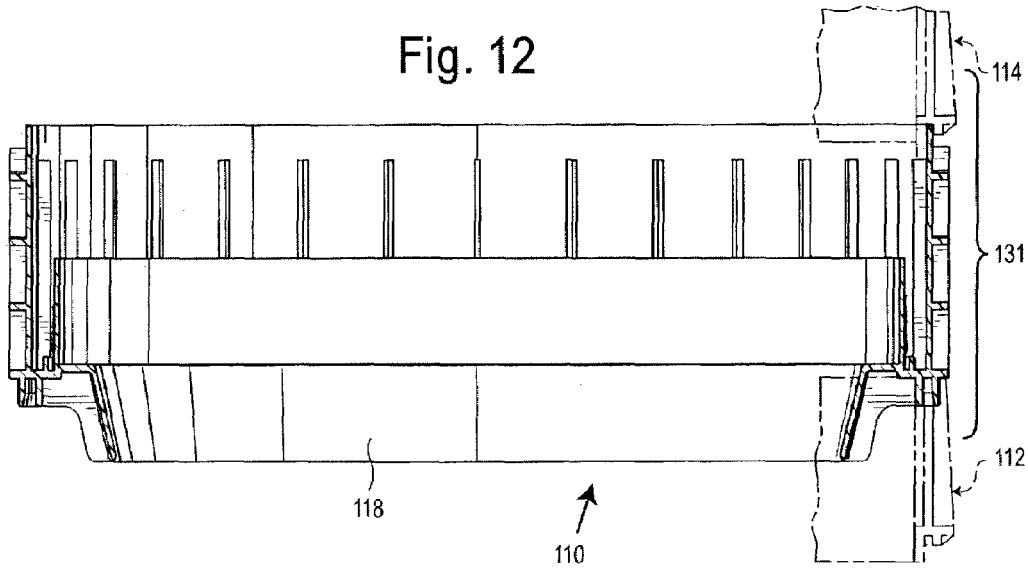
FIG. 12 is a cross-sectional view of the second embodiment riser pan of FIG. 11, taken along lines 12-12 of FIG. 11, with cross-sections of a portion of the two conventional risers immediately above and below the riser pan shown in phantom lines for better viewing.

Turning to FIGS. 11-14, a second embodiment of the riser pan 110 is shown, with like features to those described above with respect to the first embodiment being identified in this embodiment with the same reference number, increased by 100. In the second embodiment, the riser pan 110 shares many of the attributes of a riser 12, 14, as shown in FIGS. 2 and 7, but also includes a frustro-conical pan portion 118. The riser pan 110 may include one or more horizontal, outwardly-extending annular ribs 129. The ribs 129 advantageously improve rigidity of the riser pan 110, and thereby cooperate with adjacently-stacked risers 112, 114, as shown in FIG. 12, to increase the rigidity of an entire passageway 131 of a plurality of risers 112, 114 and riser pan 110.

Like the annular ledge 29 of the riser pan 10 of the first embodiment, the annular ribs 129 provide a gripping portion to facilitate handling and installation, backfill rests upon the ribs 129 to hold the riser pan 110 in position, while tending to exert downward forces on the ribs 129, which tend to push the riser pan 110 downwardly toward a next-lower riser 112 in a passageway 131. The riser pan 110 may further include a plurality of external, vertically-oriented ribs 132 along the outside of an upper cylindrical wall 116 of the riser pan 110. The vertically-oriented ribs 132 help distribute loads transmitted to the riser pan 110 from a next-higher riser 114.

Figure 13:
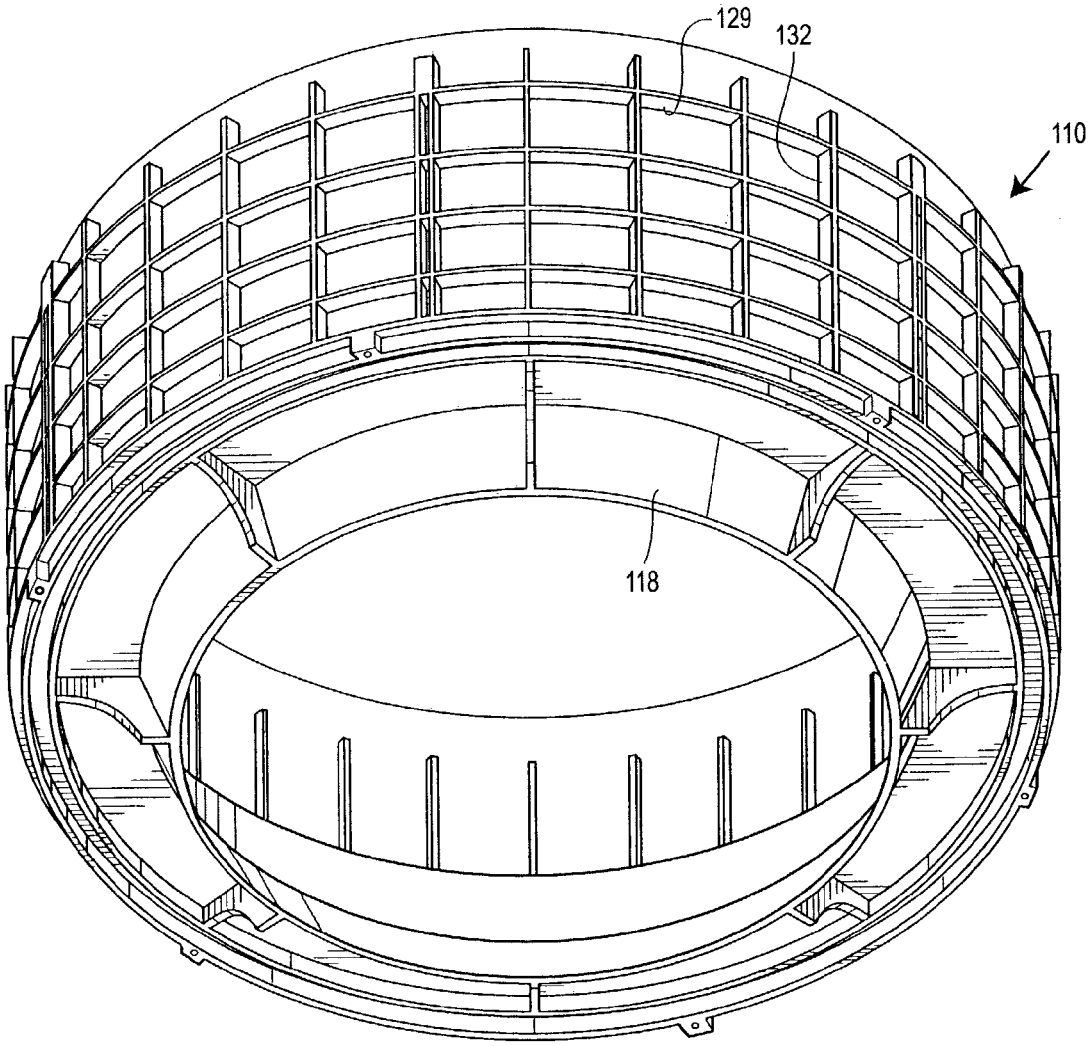
FIG. 13 is a bottom perspective view of the alternate riser pan shown in FIG. 11.

In addition to the ribs 132, several screw bosses 133, each having sidewalls 134, 136, an inner wall defined by an outer portion of the upper cylindrical wall 116, and an outer wall 137, are provided at periodic locations about the upper cylindrical wall 116. These screw bosses 133 may take the form of a pair of closely-spaced ribs which are adapted to securely receive a threaded screw therebetween. The screw bosses 133 include an enclosed portion at least near the top opening thereof, extending down to at least an uppermost of the horizontal ribs 129, as best shown in FIG. 13, so as to prevent dirt or, more importantly, concrete, from entering the screw bosses 133 and obstructing the screw-receiving opening therein. Preferably, the screw bosses 133 may be hollow cylindrical or, in the embodiment shown, substantially rectangular hollow polygonal members. The purpose of such screw bosses 133 is to enable securement of an injection molded polyethelene riser cover 138 directly to the top of another riser (not shown) or to the top of the riser pan 110, if it is desired to place a riser pan 110 at or near grade level, i.e. at the top of a passageway 131.

Figure 14:
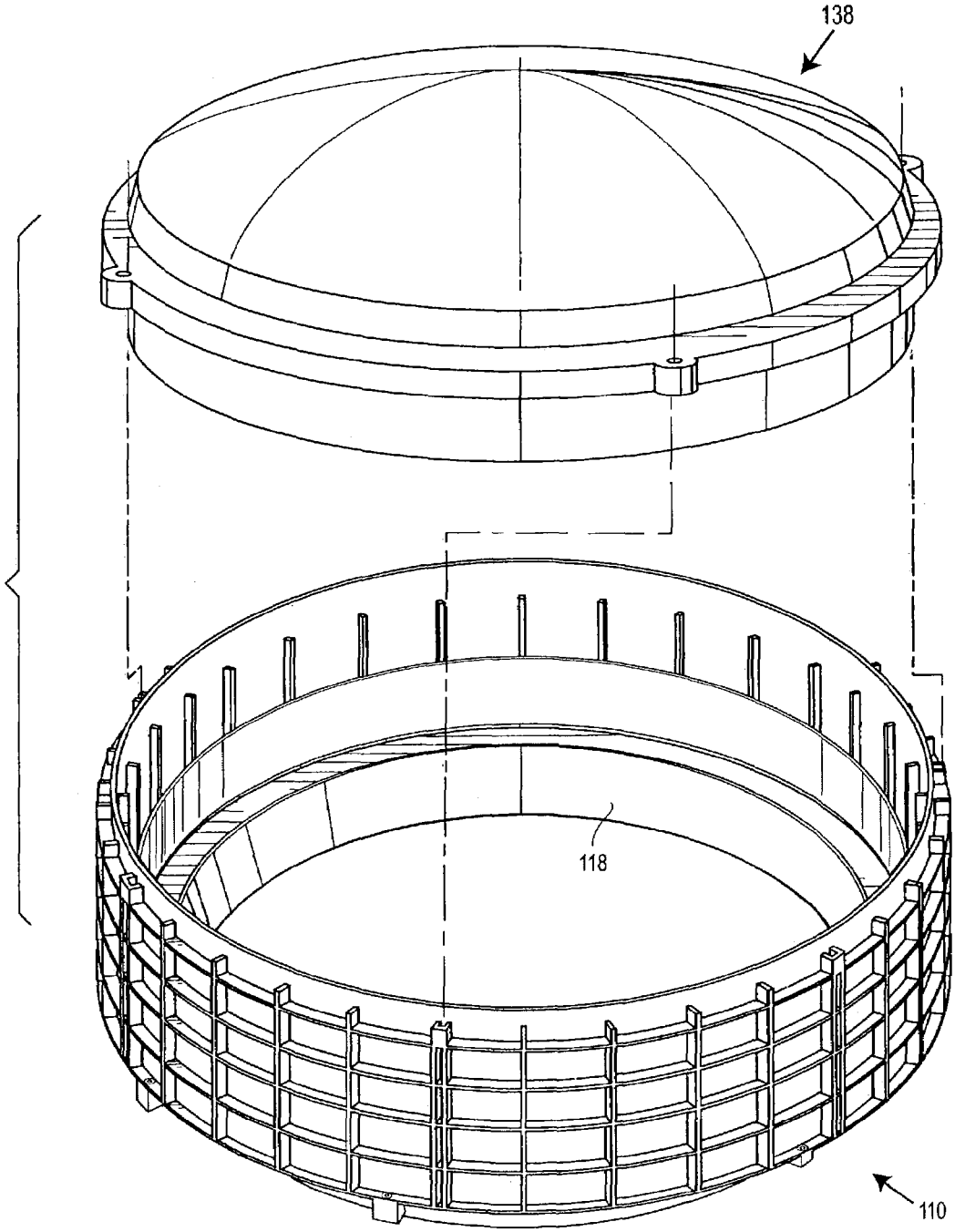
FIG. 14 is an exploded perspective view of the alternate riser pan shown in FIG. 11 in combination with an injection-molded cover for the riser pan.
Figure 15:
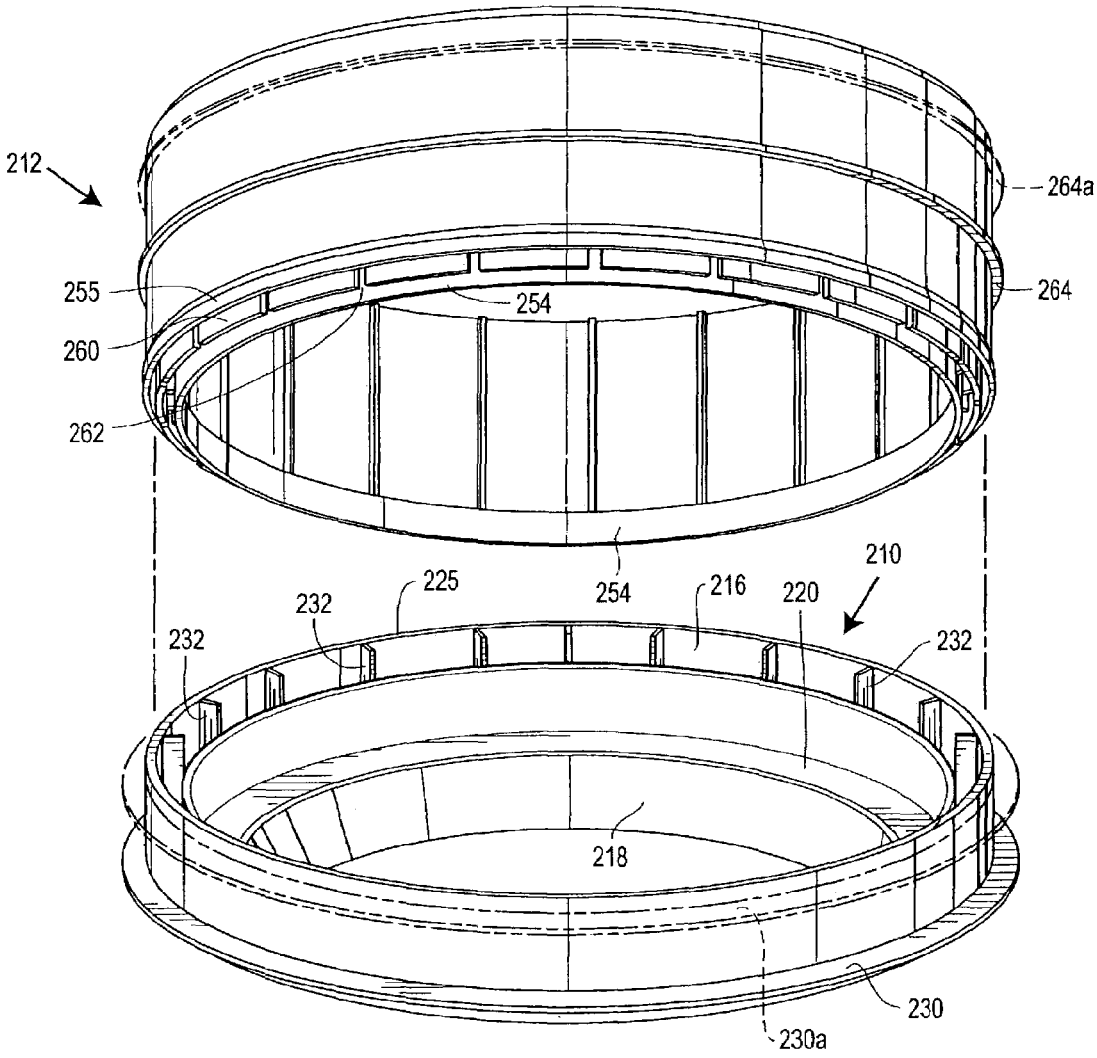
FIG. 15 is an exploded perspective view of a third embodiment of the riser pan in combination with another form of existing prior art stackable riser member, and additionally showing in phantom lines alternate, more preferred positions for the exterior annular ledge of the riser pan and for the stackable riser.
Figure 16:
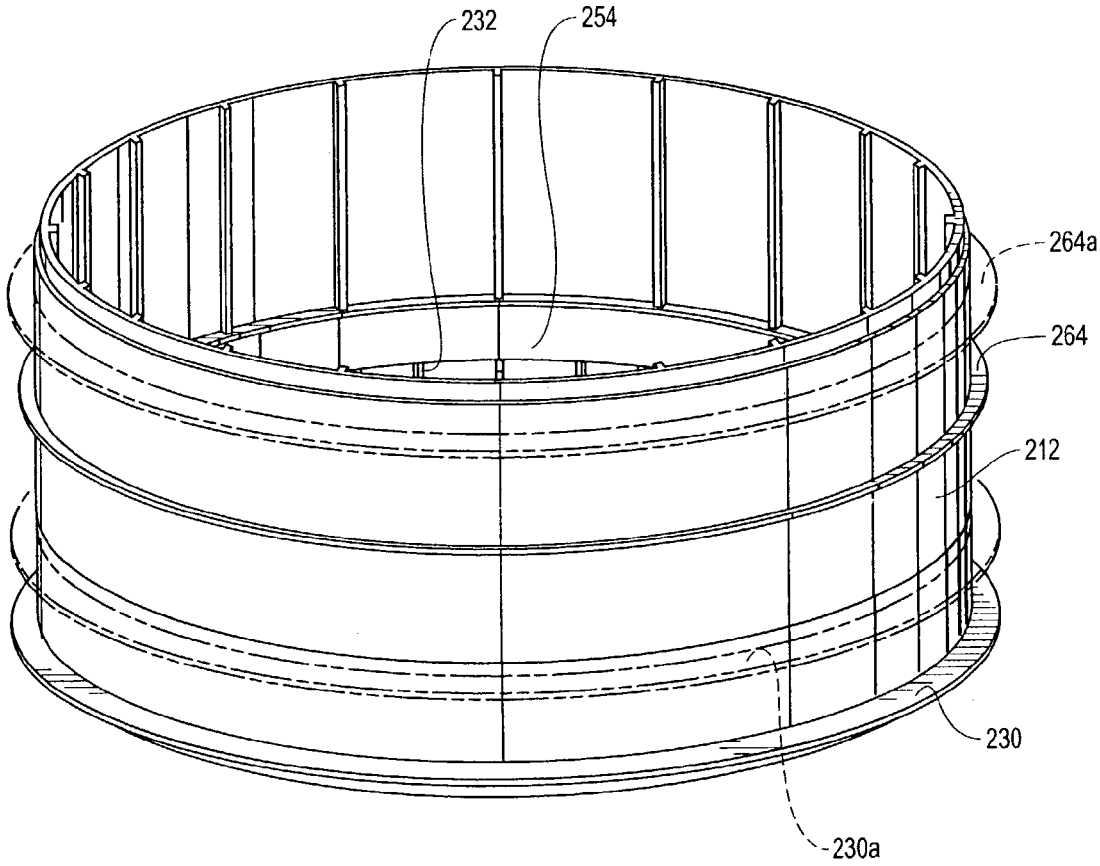
FIG. 16 is a perspective view of the alternate riser pan and prior art stackable riser combination shown in FIG. 15, and also showing in phantom lines alternate, more preferred positions for the exterior annular ledge of the riser pan and for the stackable riser.

The screw bosses 133 are sized such that the threads of the securement screw will cut into the interior walls of the screw bosses 133 upon initial securement of the molded cover 138 thereon, as shown in an exploded view in FIG. 14.

A third embodiment of the riser pan of the present invention is shown in FIGS. 15-19. In the drawing figures depicting this third embodiment, like features to those described above with respect to the first embodiment are identified with the same reference number, increased by 200. The riser pan 210 of this third embodiment, as in the embodiments described above, includes a frustro-conical pan portion 218 to accommodate a concrete septic tank cover of the type shown in FIG. 7 as reference number 58, and the riser pan 210 is adapted for use with existing prior art stackable risers 212, 214.

The riser pan 210 has an upper cylindrical wall 216 and between the upper cylindrical wall 216 and the frustro-conical pan portion 218 is an intermediate, generally flat annular ring 220. Instead of external, vertically-oriented ribs, in this third embodiment a plurality of vertically-oriented ribs 232 are provided on the inside of the upper cylindrical wall 216. Unlike the gusset extensions 52 (which are shown in FIGS. 6 and 7 to each have a flat top 53 spaced downwardly from the upper end 25 of the upper cylindrical wall 16, so as to support an inner sidewall 54 of an inverted J-shaped channel at the lower edge of a riser 12) and the vertically-oriented ribs 32 of the first embodiment (which terminate some predetermined distance below the upper end 25 of the upper cylindrical wall 16, and support the outer sidewall 55 of the inverted J-shaped channel of the riser 12), the vertically-oriented ribs 232 extend to the upper end 225 of the upper cylindrical wall 216 in this third embodiment.

The riser pan 210 includes an annular ledge 230 which may co-extend with the surface provided inside the upper cylindrical wall 216 by the generally flat annular ring 220, like in the first embodiment. However, because there are no external vertically-oriented ribs, in order to strengthen the riser pan 210 it is recognized that it may be preferable to provide the annular ledge at a higher point along the upper cylindrical wall 216, as shown in phantom lines in FIG. 15 and designated by the reference number 230*a*.

The prior art riser 212 which the riser pan 210 is adapted to receive is provided with an inverted channel with an inner sidewall 254, an outer sidewall 255, and intermediate the inner and outer sidewalls 254, 255 is an interrupted annular ring 260. The annular ring 260 is interrupted by a plurality of rib-receiving notches or gaps 262, spaced to coincide with the vertically-oriented ribs 232. The vertically-oriented ribs 232 are received in the rib-receiving notches or gaps 262, thereby interlocking the interrupted annular ring 260 with the vertically-oriented ribs 232 and preventing rotation of the riser pan 210 relative to the riser 212. Like the annular ledge 230, it is recognized that the riser 212 may be provided with an external riser ledge 264. Furthermore, as the riser 212 used in conjunction with the riser pan of this embodiment lacks external vertical ribs, it may be preferable to locate the external riser ledge 264 in a position near the upper end of the riser 212, such as shown in phantom lines in FIGS. 15, 16 as reference number 264*a*.

Figure 17:
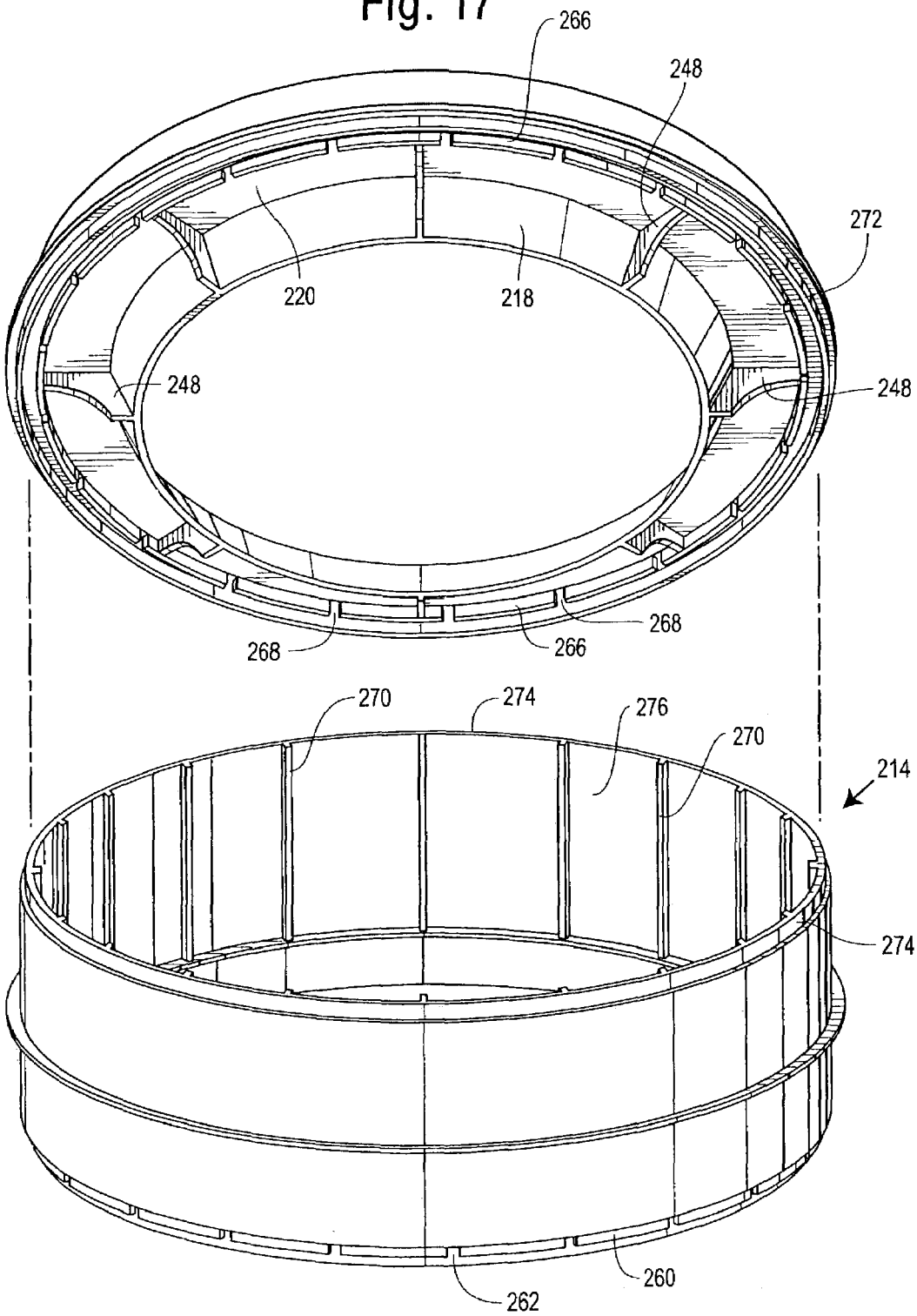
FIG. 17 is an exploded perspective view of the alternate riser pan and prior art stackable riser combination shown in FIG. 15, with the relative positions of the riser pan and stackable riser reversed, depicting this third embodiment of the riser pan stacked above the prior art stackable riser.

Turning to FIG. 17, the underside of the riser pan 210 includes a plurality of gussets 248 extending between the frustro-conical pan portion 218 and an underside of the intermediate, generally flat annular ring 220. The gussets 248 terminate at an interrupted annular ring 266. The annular ring 266 is interrupted by a plurality of rib-receiving notches or gaps 268, spaced to coincide with vertically-oriented ribs 270 located on the the inside cylindrical wall of a riser 214. An annular wall 272 may also extend downwardly from the annular ledge 230, spaced outwardly of the interrupted annular ring 266, forming a channel between the interrupted annular ring 266 and the annular wall 272 to receive an upper edge 274 of the sidewall 276 of the prior art stackable riser 214.

Figure 18:
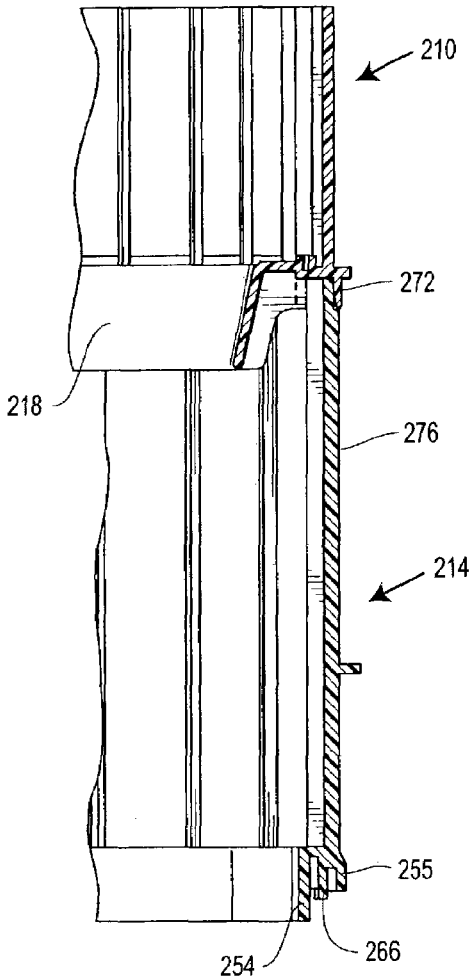
FIG. 18 is a cross-sectional view, broken away, of the alternate riser pan and stackable riser combination shown in FIG. 17.
Figure 19:
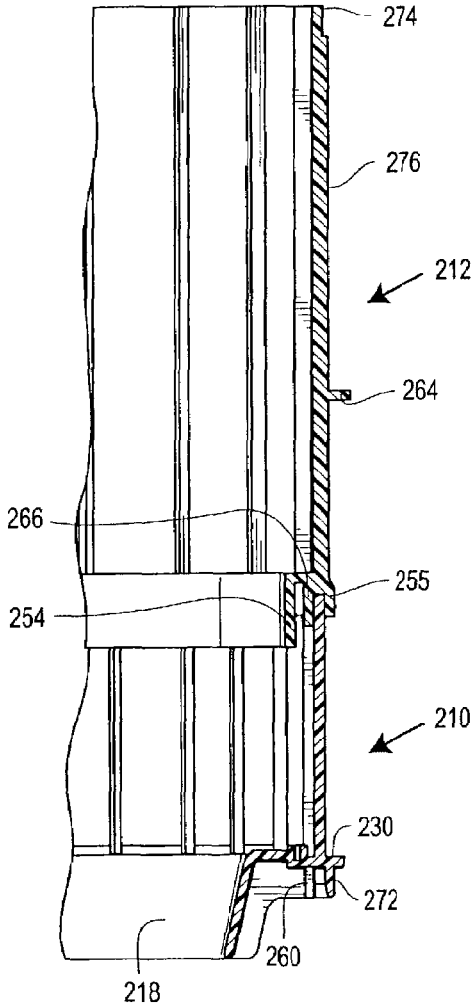
FIG. 19 is a cross-sectional view, broken away, of the alternate riser pan and stackable riser combination shown in FIGS. 15 and 16.

As seen in FIGS. 18, 19 the upper edge 274 of the sidewall 276 of the risers 212, 214 may be stepped inwardly, i.e. having a reduced thickness as compared to the rest of the sidewall 276, so that the annular wall 272 forms a continuous wall with the sidewall 276 of the risers 212, 214 when stacked to form a vertical conduit or passageway. This will enhance the transfer of vertical loads downwardly through the stack.

Figure 20:
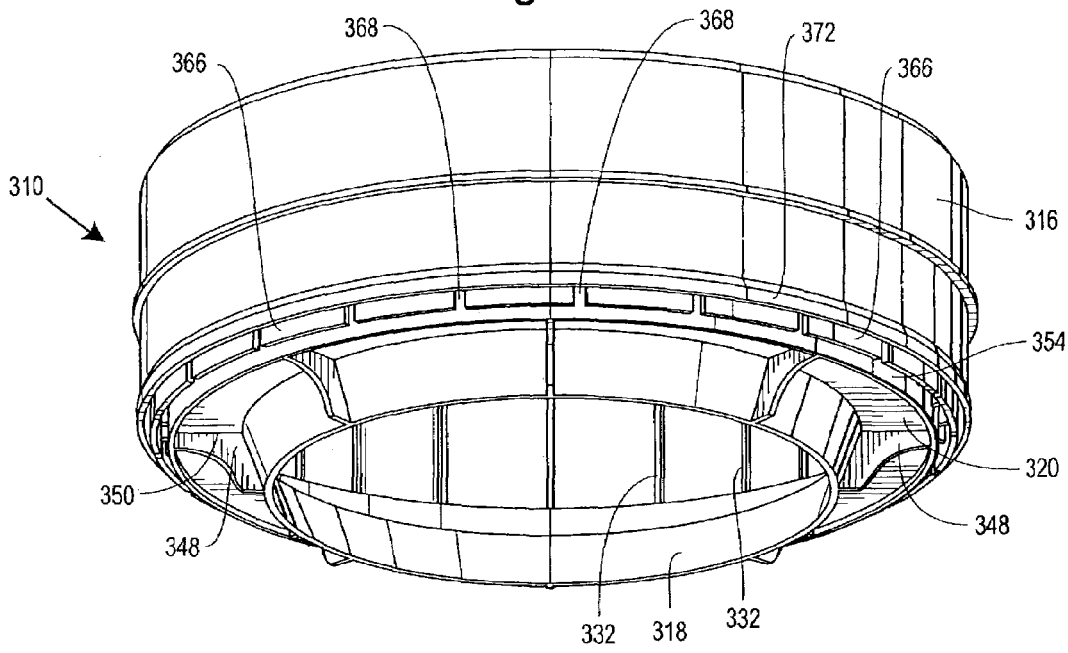
FIG. 20 is a perspective view of a fourth embodiment of the riser pan, as integrally formed with the alternate type of riser member shown in FIG. 15.
Figure 21:
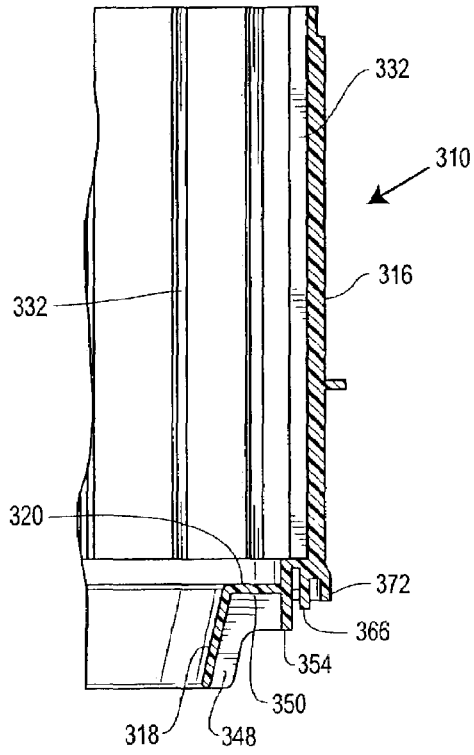
FIG. 21 is a cross-sectional view, broken away, of the alternate riser pan and riser integral combination as shown in FIG. 20.

A fourth embodiment of the riser pan is shown in FIGS. 20 and 21. Like features to those described above with respect to the first embodiment are identified with the same reference number, increased by 300. The riser pan 310 is essentially a hybrid of the second and third embodiments described above. Like the riser pan 110 of the second embodiment, the integral combination riser and riser pan 310 of this fourth embodiment preferably has a cylindrical sidewall 316 of a height similar to the height of a regular riser, but also includes a frustro-conical portion 318 to accommodate a secondary cover like the concrete cover 58 shown in FIG. 7.

Like the riser pan 210 of the third embodiment, the riser pan 310 has at the lower end of the cylindrical sidewall 316 an interrupted annular ring 366, which is interrupted by a plurality of rib-receiving notches or gaps 368. An annular wall 372 may be provided axially outwardly of the interrupted annular ring 366, preferably as an integral extension of the sidewall 316. An inner sidewall 354 of an inverted channel is also provided axially inwardly of the interrupted annular ring 366.

The riser pan 310 further includes a plurality of vertically-oriented ribs 332, which in this embodiment are located on the interior of the cylindrical sidewall 316 of the riser pan 310. For purposes of nesting the riser pan 310 with other similar riser pans for shipping or storage, the rib-receiving notches or gaps 368 are sized to accommodate the vertically-oriented ribs 332 of a next-lower riser pan. Likewise, the vertical ribs 270 of a riser 214, such as on the riser shown in FIG. 17, fit within the rib-receiving gaps 368. Thus, the interrupted annular ring 366 at the lower end of the wall 316 of the riser pan 310 can lockingly receive either a riser 214 or another riser pan 310.

The riser pan 310 also has gussets 348 extending between the exterior of the frustro-conical portion 318 and the inner sidewall 354. The flat edge 350 at the top of each of the gussets 348 rests along an intermediate, generally flat annular ring 320 running between the frustro-conical portion 318 and the inner sidewall 354.

Figure 22:
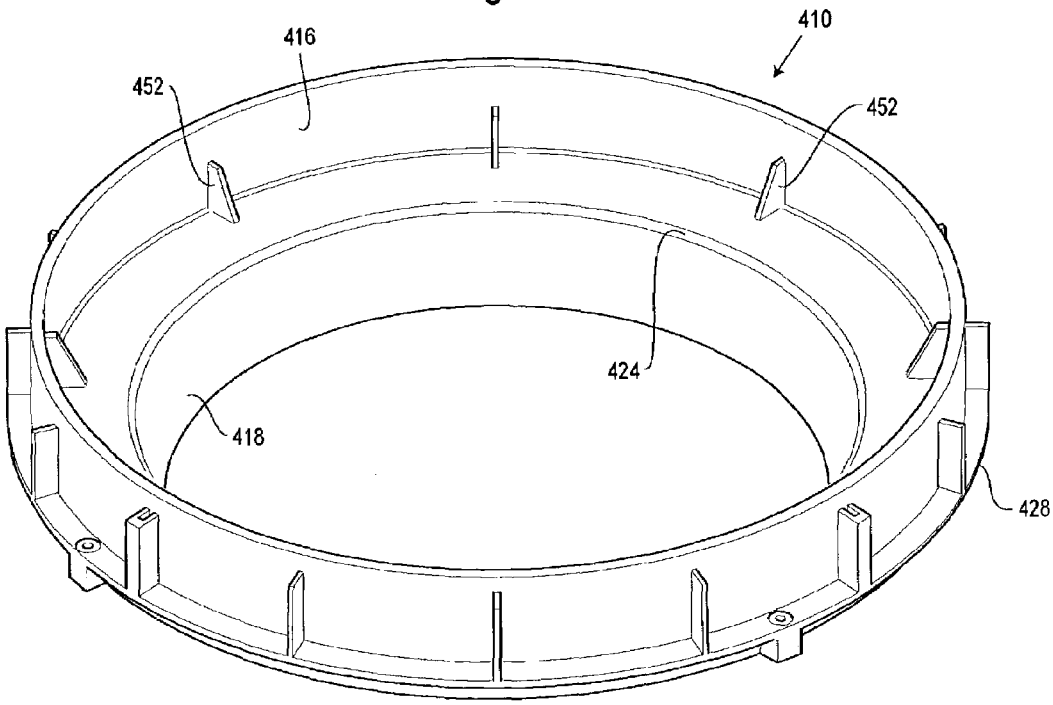
FIG. 22 is a perspective view of a riser pan of a fifth embodiment of the present invention.
Figure 23:
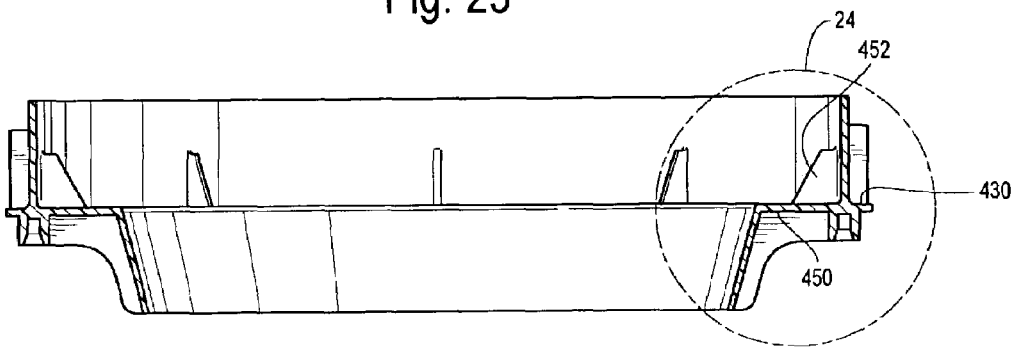
FIG. 23 is a cross-sectional view of the riser pan shown in FIG. 22, taken along lines 23-23 of FIG. 22.
Figure 24:
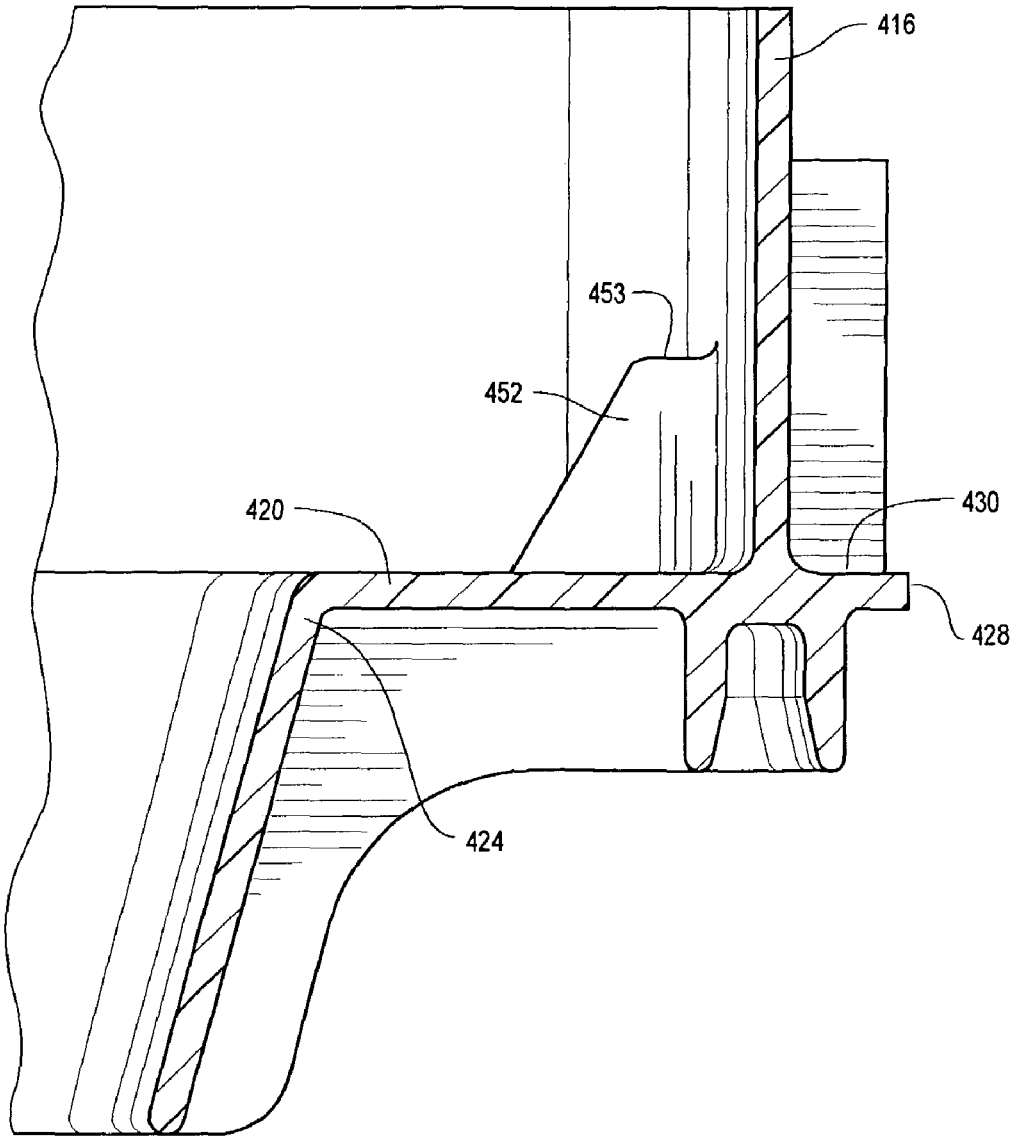
FIG. 24 is an enlarged cross-sectional view, broken away, taken along circular line 24 in FIG. 23 of the riser pan of FIGS. 22 and 23.

In yet another, i.e. fifth embodiment, shown in FIGS. 22-24, the riser pan 400 may be similar in most respects to the first embodiment described above, but omits the standing circular rib. Instead, the generally flat annular ring 420 extends from the upper end 424 of the frustro-conical pan portion 418, through the upper cylindrical sidewall 416, and terminates at an outer edge 428, outside the upper cylindrical sidewall 416, thus forming an annular ledge 430 on the exterior of the upper cylindrical sidewall 416. Contrary to the gusset extensions 52 described above with respect to the first embodiment, the gusset extensions 452 of this embodiment do not terminate along an outer surface of a standing circular rib, because there is no such standing circular rib. Instead, each of the gusset extensions 452 has an angled surface that extends from a flat top 453 of the gusset extension 452 to the generally flat annular ring 420. In all other respects, the riser pan 410 of this embodiment is substantially identical to the riser pan 10 disclosed in the first embodiment, so further description of the present embodiment is omitted as unnecessarily duplicative.

Figure 25:
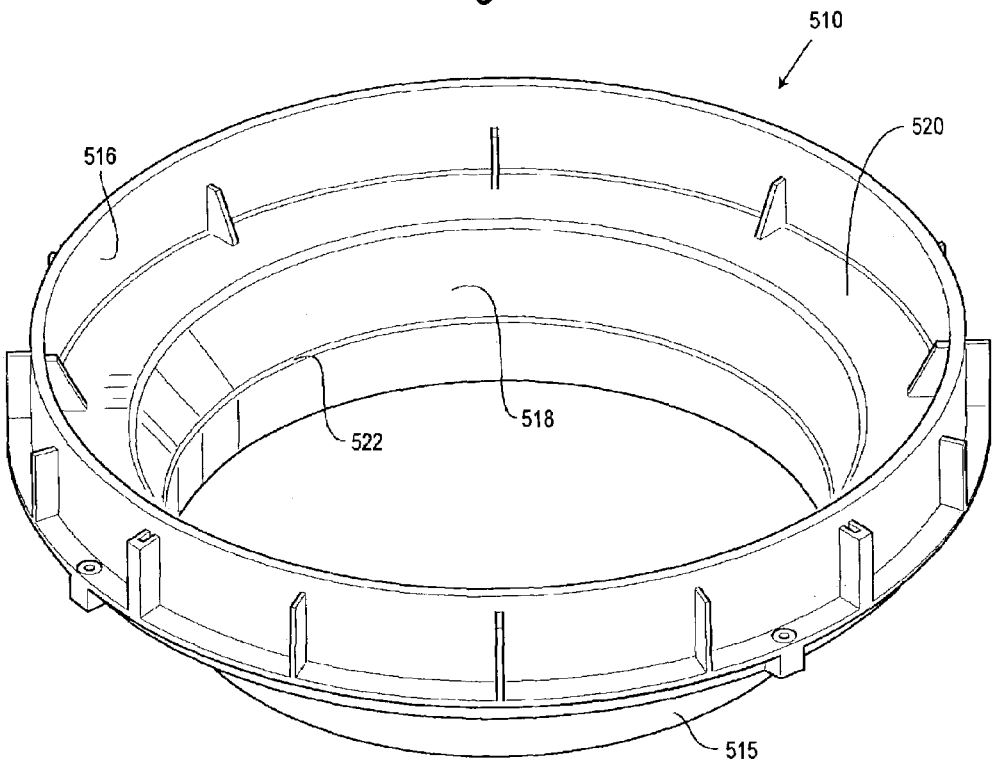
FIG. 25 is a perspective view of a riser pan of a sixth embodiment of the present invention.
Figure 26:
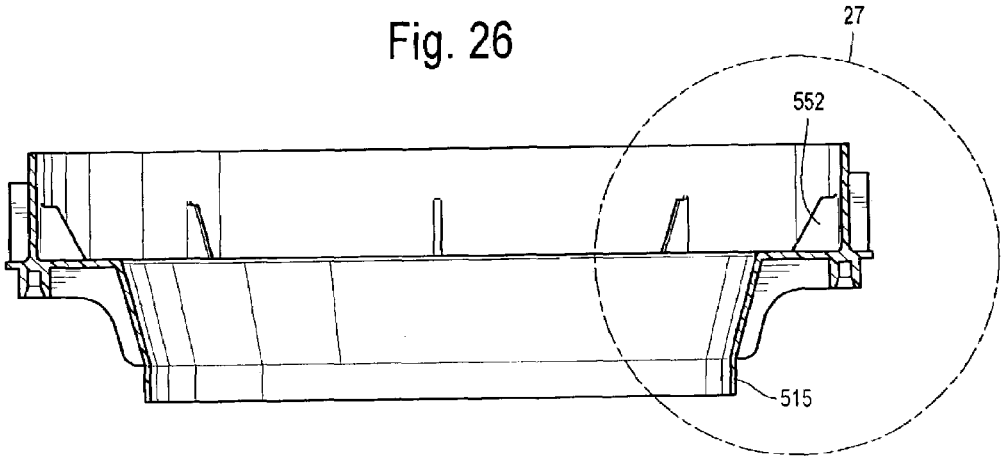
FIG. 26 is a cross-sectional view of the riser pan shown in FIG. 25, taken along lines 26-26 of FIG. 25.
Figure 27:
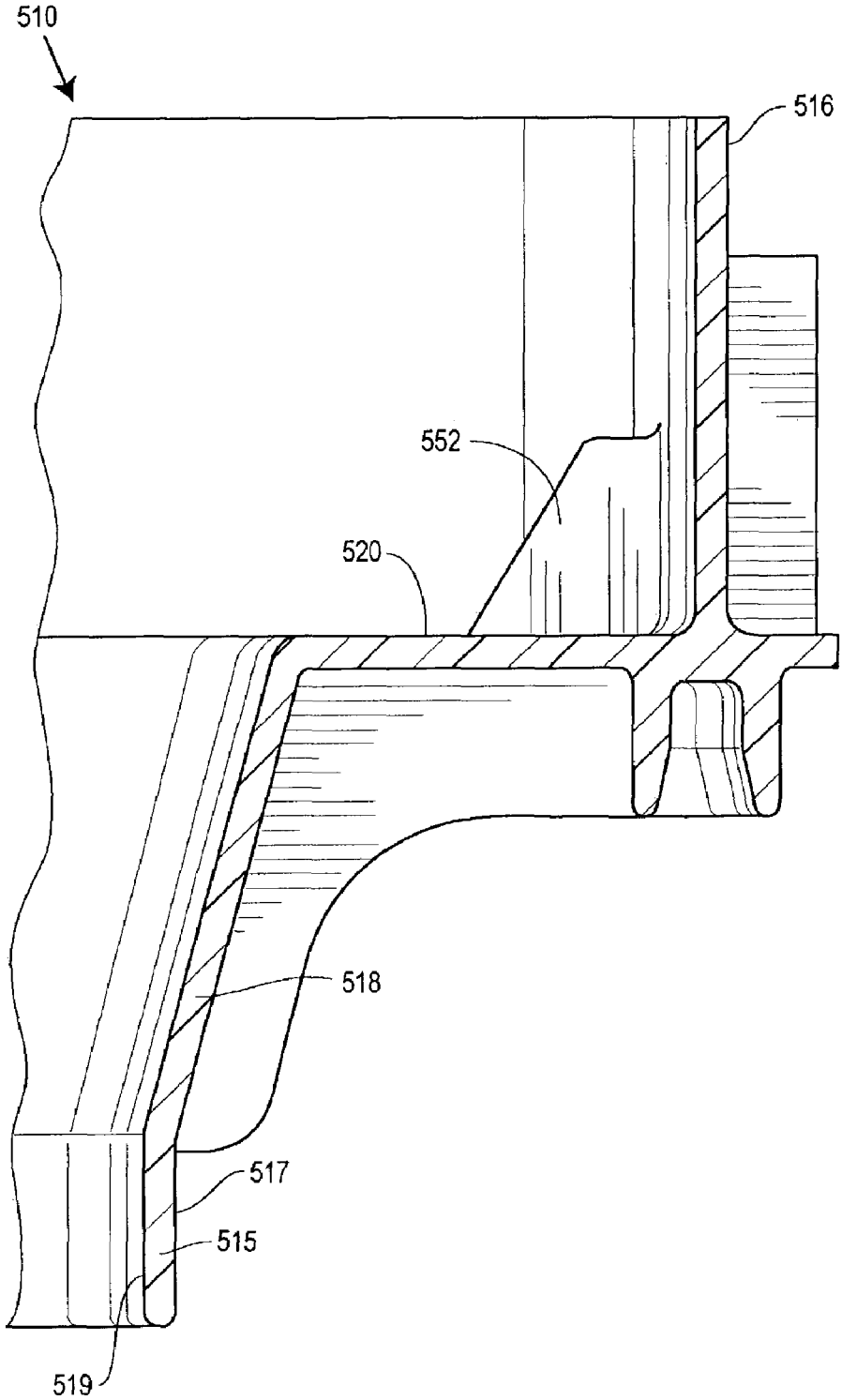
FIG. 27 is an enlarged cross-sectional view, broken away, taken along circular line 27 in FIG. 26 of the riser pan of FIGS. 25 and 26.

In a sixth embodiment of the riser pan 510, shown in FIGS. 25-27, instead of a standing circular rib 15 extending upwardly from the annular ring 20, as in the first embodiment of the riser pan 10, a downwardly-depending circular rib 515 extends from the lowermost end 522 of the frustro-conical pan portion 518. The downwardly-depending circular rib 515 preferably has two parallel vertical surfaces 517, 519, as opposed to a vertical outer surface 17 and inclined inner surface 19. However, it is recognized that the inner surface 519 may be inclined, if desired by the manufacturer, to facilitate casting of a cover within the riser pan 510.

The riser pan 510 includes gussets 552 and a generally flat annular ring 520 as in the fifth embodiment riser pan 410, described above, as well as other aspects shown in the drawing figures and described above with respect to previous embodiments, but not described in detail with respect to this embodiment for the sake of avoiding unnecessary repetition.

Like the standing circular rib 15 shown and described in the first embodiment riser pan 10, the downwardly-depending circular rib 515 of this sixth embodiment facilitates casting in place of a relatively thicker concrete cover (not shown). Inasmuch as many septic tank lids may have a thickness greater than the height of the frustro-conical pan portion 518, the circular rib 515 effectively increases the height available in which to cast a concrete cover without the concrete spilling over into the interior region of the riser pan 510 bounded by the upper cylindrical sidewall 516. The resulting concrete cover would have a two-tiered shape, with a lowermost generally cylindrical portion coinciding with the region of the interior of the riser pan 510 bounded by the downwardly-depending circular rib 515, and an upper conical portion coinciding with the region of the interior of the riser pan 510 bounded by the frustro-conical pan portion 518.

Figure 30:
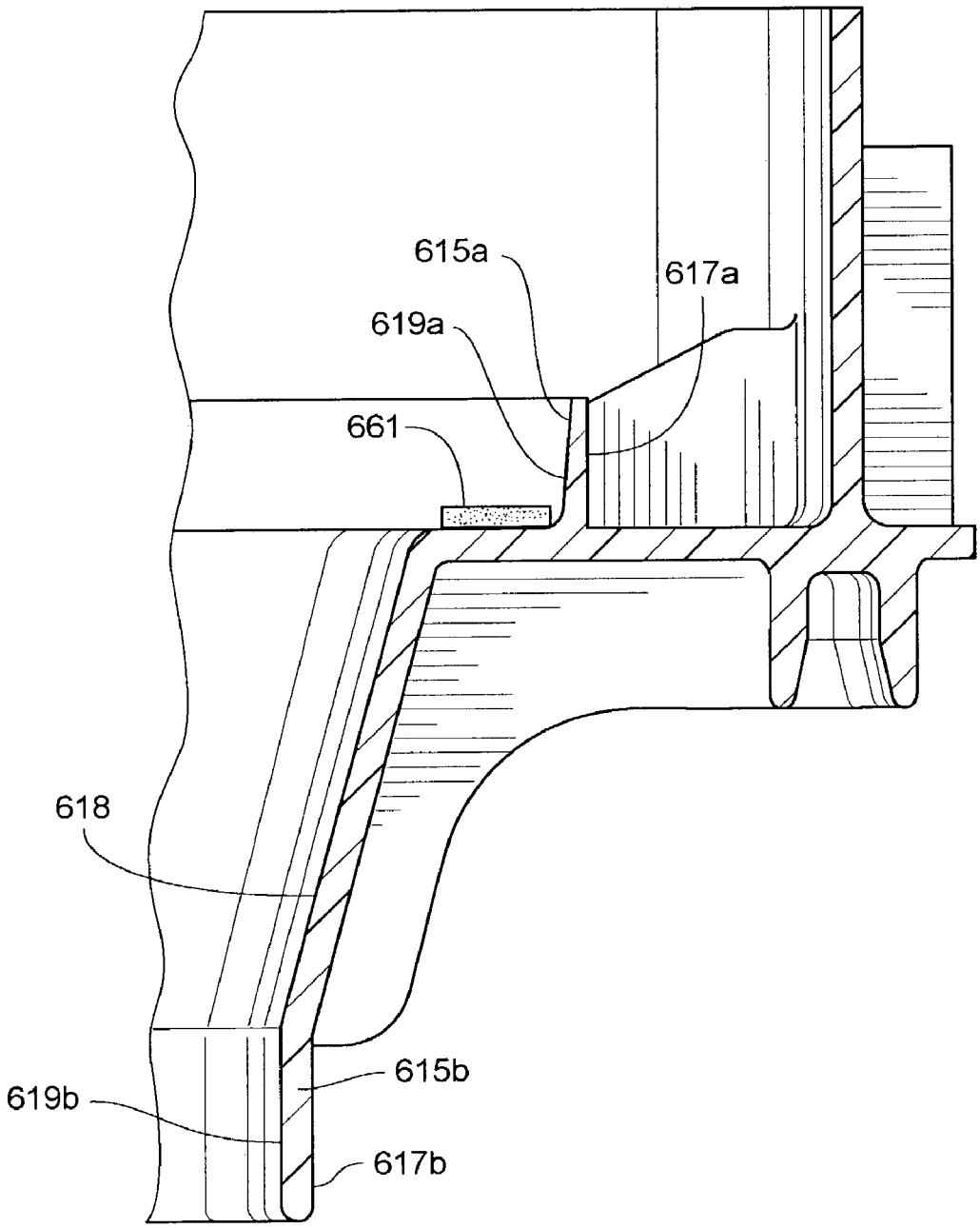
FIG. 30 is an enlarged cross-sectional view, broken away, taken along circular line 30 in FIG. 29 of the riser pan of FIGS. 28 and 29, and showing a cross-section of a sealing gasket provided on the interior of the riser pan.

Turning to FIGS. 28-30, a seventh embodiment riser pan 610 utilizes both a standing. circular rib 615*a*, as in the first embodiment, and a downwardly-depending circular rib 615*b*, as in the sixth embodiment. The standing circular rib 615*a* preferably has a vertical outer surface 617*a* and an inclined inner surface 619*a,* similar to the surfaces 17 and 19 in the first embodiment described above. As in the sixth embodiment, the downwardly-depending circular rib 615*b* preferably has parallel outer and inner surfaces 617*b,* 619*b,* but it is recognized that the inner surface 619*b* may be inclined, if desired by the manufacturer, to facilitate casting of a cover within the riser pan 610.

By providing the standing circular rib 615*a,* the riser pan 610 advantageously assists in preventing the cover, once removed from the riser pan 610, from being crookedly placed back into the riser pan 610, like in the first embodiment. As opposed to a two-tiered profile complimenting an inclined pan portion, a step, and an inclined standing circular rib, however, a cover cast into the riser pan 610 would have a profile complimenting not only those portions of the riser pan 610, but also complimenting the inner surface 619*b* of the downwardly-depending rib 615*b.* An O-ring or annular sealing gasket 661 may also be provided on the step portion 621 intermediate the standing circular rib 615*a* and the pan portion 618 to facilitate a liquid-tight sealing engagement between the riser pan 610 and an internal cover received therein.

It will be recognized that variations to the foregoing description of the preferred embodiment may be made without departing from the present invention, and which would still be within the scope of the appended claims. For example, the riser pan may have a square or other polygonal shape, rather than round, and the frustro-conical pan portion may have the same or a different shape than the outer wall of the riser pan, as may be desirable for use with stackable risers or other passageways having shapes other than cylindrical.

I claim:

1. A modular passageway component comprising:

a generally cylindrical body including an upper portion, a lower portion, and a generally flat annular ring intermediate the upper portion and the lower portion;

the upper portion including a vertical wall extending upwardly from and terminating at a bottom of the vertical wall at the generally flat annular ring, the vertical wall adapted to receive a second passageway component;

the lower portion including a pan having an opening therein, the pan extending downwardly from and terminating at a top of the pan at the generally flat annular ring and having an inclined shape in cross-section, said inclined shape slanting inwardly, from the top of the pan at the generally flat annular ring to a bottom of the pan, toward a central axis of the generally cylindrical body, and the pan being adapted to seatably receive a cover; and a cover seated in the pan, the cover having a shape complementary to the pan.

2. The modular passageway component of claim 1, wherein the complementary shape is one of angled, generally curved, and stepped.

* * * * *

UNITED STATES PATENT AND TRADEMARK OFFICE

CERTIFICATE OF CORRECTION

PATENT NO. : 7,574,831 B2
APPLICATION NO. : 10/352086
DATED : August 18, 2009
INVENTOR(S) : Theodore W. Meyers It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1182 days.

Signed and Sealed this

Seventh Day of September, 2010

David J. Kappos

David J. Kappos
*Director of the United States Patent and Trademark Office*